US009256153B2

(12) United States Patent
Aoyama et al.

(10) Patent No.: US 9,256,153 B2
(45) Date of Patent: Feb. 9, 2016

(54) CHARGING MEMBER, PROCESS CARTRIDGE AND ELECTROPHOTOGRAPHIC APPARATUS

(71) Applicant: CANON KABUSHIKI KAISHA, Tokyo (JP)

(72) Inventors: Takehiko Aoyama, Suntou-gun (JP); Taichi Sato, Numazu (JP); Tomohito Taniguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/680,034

(22) Filed: Apr. 6, 2015

(65) Prior Publication Data

US 2015/0301469 A1 Oct. 22, 2015

(30) Foreign Application Priority Data

Apr. 18, 2014 (JP) ..... 2014-086421

(51) Int. Cl.
*G03G 15/02* (2006.01)

(52) U.S. Cl.
CPC ..... *G03G 15/0208* (2013.01)

(58) Field of Classification Search
CPC ..... G03G 15/0208
See application file for complete search history.

(56) References Cited

U.S. PATENT DOCUMENTS

2010/0135695 A1* 6/2010 Mayuzumi ..... G03G 15/0233 399/111
2014/0295336 A1* 10/2014 Miyagawa ..... G03G 21/18 430/56
2014/0308607 A1* 10/2014 Taniguchi ..... G03G 5/04 430/57.1
2015/0003874 A1* 1/2015 Aoyama ..... G03G 21/18 399/176
2015/0087489 A1* 3/2015 Sato ..... G03G 5/087 492/18

FOREIGN PATENT DOCUMENTS

| | | | | |
|---|---|---|---|---|
| JP | 05035086 | A | * | 2/1993 |
| JP | 2003-316112 | A | | 11/2003 |
| JP | 2008-158437 | A | | 7/2008 |
| JP | 2008158437 | A | * | 7/2008 |
| JP | 2008276023 | A | * | 11/2008 |
| JP | 2008276026 | A | * | 11/2008 |
| JP | 2009175427 | A | * | 8/2009 |
| JP | 2010113177 | A | * | 5/2010 |
| JP | 2010181819 | A | * | 8/2010 |
| JP | 2012168259 | A | * | 9/2012 |
| JP | 2012173360 | A | * | 9/2012 |

OTHER PUBLICATIONS

Tohara, et al., "Anti-Vibration Rubber", New Edition, Japan Association of Rolling Stock Industries, 1998, pp. 97-99.
Tohara, et al., "Anti-Vibration Rubber", New Edition, 1998, pp. 97-99.

* cited by examiner

*Primary Examiner* — Clayton E Laballe
*Assistant Examiner* — Sevan A Aydin
(74) *Attorney, Agent, or Firm* — Fitzpatrick, Cella, Harper and Scinto

(57) ABSTRACT

Provided a charging member including an electro-conductive substrate and a surface layer. The surface layer includes a binder resin, and a resin particle that roughens the surface layer. A surface of the charging member has a plurality of protrusions each derived from the resin particle. The resin particle has a pore inside thereof, has a porosity Vt of 1.5% by volume or more and 45.0% by volume or less, and has a first and second regions. The first region has a porosity V1, the second region thereof has a porosity V2, and V1 is larger than V2.

9 Claims, 4 Drawing Sheets

CHARGING MEMBER, PROCESS CARTRIDGE AND ELECTROPHOTOGRAPHIC APPARATUS

BACKGROUND OF THE INVENTION

1. Field of the Invention

The present invention relates to a charging member for use in an electrophotographic apparatus, and a process cartridge and an electrophotographic apparatus using the charging member.

2. Description of the Related Art

An electrophotographic apparatus using electrophotography mainly includes an electrophotographic photosensitive member, a charging apparatus, an exposure apparatus, a developing apparatus, a transfer apparatus and a fixing apparatus. For the charging apparatus, contact charging apparatuses are often used which apply voltage to the charging member disposed in contact with or in the vicinity of the surface of the electrophotographic photosensitive member. Here, only DC voltage, or voltage of DC voltage superimposed with AC voltage is applied to the charging member.

For more stable charging of the electrophotographic photosensitive member by contact charging, Japanese Patent Application Laid-Open No. 2003-316112 proposes a charging member for contact charging including a surface layer having a protrusion derived from a resin particle or the like in the surface.

On the other hand, a contact charging apparatus in which DC voltage is applied to a charging member with being superimposed with AC voltage may cause vibration noise generated by resonance of an electrophotographic photosensitive member with the charging member due to charges generated on the surfaces of the electrophotographic photosensitive member and the charging member. For dealing with such a problem, Japanese Patent Application Laid-Open No. 2008-158437 proposes use of a hollow spherical inelastic particle as a resin particle that roughens a surface layer of a charging member, to thereby enhance vibration resistance, and sound insulation and sound absorption effects.

SUMMARY OF THE INVENTION

The present invention is directed to providing a charging member that hardly causes vibration and that can stably charge an electrophotographic photosensitive member, even in the case of use of a contact charging system. Moreover, the present invention is directed to providing a process cartridge and an electrophotographic image forming apparatus useful for stable formation of a high-quality electrophotographic image.

One aspect of the present invention provides a charging member comprising: an electro-conductive substrate; and a surface layer, wherein: the surface layer comprises a binder resin, and a resin particle that roughens the surface layer; a surface of the charging member has a plurality of protrusions each derived from the resin particle: the resin particle has a pore inside thereof, has a porosity Vt of 1.5% by volume or more and 45.0% by volume or less as a whole, and has a first region and a second region, wherein: assuming that the resin particle is a solid particle having no pores, each of the first region and the second region corresponds to a region occupying ½ of a total volume of the solid particle, the first region being located in the resin particle nearest to the electro-conductive substrate, and having a porosity V1 of 2.0% by volume or more and 90.0% by volume or less, the second region being located in the resin particle farthest away from the electro-conductive substrate, and having a porosity V2 of 0.0% by volume or more and 20.0% by volume or less, and wherein: the porosity V1 is larger than the porosity V2.

In addition, another aspect of the present invention provides a process cartridge detachably mountable on a main body of an electrophotographic apparatus, including a charging member and a member to be charged disposed in contact with the charging member, wherein the charging member is the above charging member.

Furthermore, another aspect of the present invention provides an electrophotographic image forming apparatus including a charging member and a member to be charged disposed in contact with the charging member, wherein the charging member is the above charging member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to demands for a higher image quality and a higher speed in an electrophotographic apparatus in recent years, an AC voltage at a high frequency of, for example, about 3000 Hz has been applied to a charging member. In addition, according to a high-speed rotation of an electrophotographic photosensitive member, a motor that drives the electrophotographic photosensitive member, and also a gear that transmits the driving force of the motor are vibrated. Therefore, the contact of the electrophotographic photosensitive member with the charging member is easily more unstable. As a result, it may be difficult to stably charge the electrophotographic photosensitive member, causing deterioration in quality of an electrophotographic image.

Furthermore, when the charging member is used in a contact charging system, as for the charging member and the electrophotographic photosensitive member, only protrusions in the charging member surface are often brought into contact with the electrophotographic photosensitive member. In such a case, the pressure due to vibration is collected on the protrusions in the charging member surface. Therefore, such vibration causes the protrusions in the charging member surface to be more deformed in the vicinity of the vertexes of the protrusions. Such deformation may move a conductive agent present in the vicinity of the vertexes of the protrusions, resulting in a variation in resistance in the vicinity of the vertexes of the protrusions. When the variation in resistance is caused in the vicinity of the vertexes of the protrusions, abnormal discharge may occur to remarkably generate an image with streaks (hereinafter, referred to as "streaked image") due to such abnormal discharge.

The inventors of the present invention have made intensive studies and as a result have completed the invention that is directed to providing a charging member that hardly causes vibration and that can stably charge an electrophotographic photosensitive member, even in the case of use of a contact charging system.

Figure 1A:
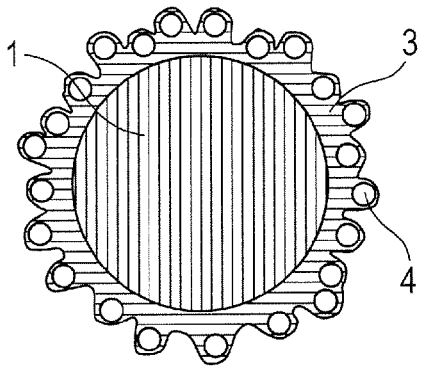
FIG. 1A and FIG. 1B each are a sectional view of a charging member according to one aspect of the present invention.
Figure 1B:
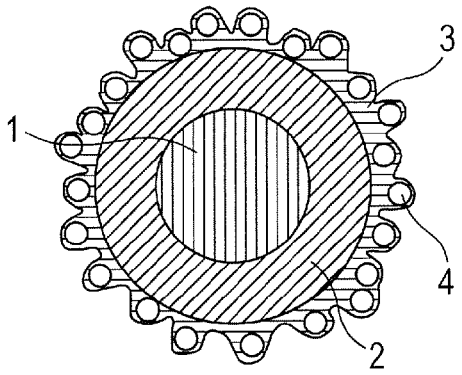

FIG. 1A and FIG. 1B illustrate a cross-section of a charging member according to one aspect of the present invention.

The charging member in FIG. 1A includes an electro-conductive substrate 1, and a surface layer 3 that covers the circumferential surface of the electro-conductive substrate 1. In FIG. 1B, the charging member includes an elastomer layer 2 between the electro-conductive substrate 1 and the surface layer 3. The surface layer 3 contains a binder resin, and a resin particle 4 that roughens the surface of the charging member.

Figure 2:
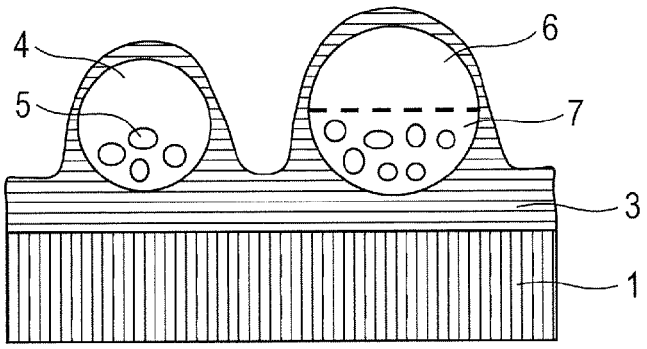
FIG. 2 is a partial sectional view of the vicinity of the surface of the charging member according to one aspect of the present invention.

FIG. 2 is an enlarged sectional view of the vicinity of the surface of the surface layer 3 of the charging member according to the present invention. The surface of the surface layer has a plurality of protrusions (hereinafter, referred to as "protrusions") derived from the resin particle 4.

The resin particle 4 that generates protrusions in the surface of the charging member has a pore inside thereof, and the resin particle has a porosity Vt of 1.5% by volume or more and 45% by volume or less as a whole and can have a porosity Vt of 5.0% by volume or more and 42% by volume or less as a whole.

In the resin particle 4, a first region is defined as a region (reference number 7 in FIG. 2) that corresponds to a region occupying ½ of the total volume of a solid particle having no pores under assumption of the resin particle as the solid particle, and that is located at a shorter distance from the electro-conductive substrate. The first region has a porosity V1 of 2.0% by volume or more and 90.0% by volume or less.

In addition, in the resin particle 4, a second region is defined as a region (reference number 6 in FIG. 2) that corresponds to a region occupying ½ of the total volume of a solid particle having no pores under assumption of the resin particle as the solid particle, and that is located at a longer distance from the electro-conductive substrate. The second region of the resin particle 4 has a porosity V2 of 0.0% by volume or more and 20.0% by volume or less. In the resin particle 4, the porosity V1 is larger than the porosity V2.

That is, the pore in the resin particle 4 is unevenly present in the first region 7 closer to the electro-conductive substrate (hereinafter, referred to as "closer to the substrate").

Herein, the porosity Vt means the ratio of the sum of the volume Vv of the pore present in the resin particle to the total volume Vr of the solid particle under assumption of the resin particle as the solid particle, i.e., ((Vv/Vr)×100)%.

The inventors of the present invention have made intensive studies about vibration of the charging member in rotation of the charging member and the electrophotographic photosensitive member in contact with each other. In the course of such studies, the inventors of the present invention have observed an abutting portion of the charging member with the electrophotographic photosensitive member in detail. As a result, the inventors of the present invention have found that a charging member having a protrusion generated in the surface thereof by use of a porous resin particle having a pore unevenly present closer to an electro-conductive substrate can effectively absorb vibration transmitted from the electrophotographic photosensitive member to allow contact of the charging member with the electrophotographic photosensitive member to be stabilized. The present invention has been made based on such a finding.

The reason why the charging member according to the present invention exerts the above effect is considered by the inventors of the present invention as follows.

That is, the resin particle that allows a protrusion to be generated in the surface of the charging member according to the present invention has a pore inside thereof, and the resin particle has a porosity Vt of 1.5% by volume or more and 45.0% by volume or less as a whole.

Furthermore, the first region of the resin particle 4 has a porosity V1 of 2.0% by volume or more and 90.0% by volume or less.

In addition, the second region of the resin particle 4 has a porosity V2 of 0.0% by volume or more and 20.0% by volume or less. In addition, the V1 is larger than the V2.

A pore is thus unevenly present in the first region 7 of the resin particle 4, and therefore the first region 7 is more flexible than the second region 6. That is, the resin particle in the present invention has a configuration in which two layers having a different flexibility are laminated (hereinafter, also referred to as "quasi-bilayer structure").

The quasi-bilayer structure, when the electrophotographic photosensitive member being brought into contact with the protrusions in the surface of the charging member, allows a region of the resin particle, closer to the member surface, to be hardly deformed, and allows a region of the resin particle, closer to the substrate, to be easily deformed. Such deformation of the quasi-bilayer structure enables to suppress vibration transmitted from the electrophotographic photosensitive member to a protrusion in the surface of the charging member. In addition, the region of the resin particle, closer to the substrate, can be more deformed against the vibration than the region thereof closer to the member surface, thereby inhibiting the region of the resin particle, closer to the member surface, from being deformed. Such deformation is referred to as selective deformation of the region of the resin particle, closer to the substrate. Due to the selective deformation of the region of the resin particle, a binder resin in the vicinity of the surface of a protrusion is not deformed and movement of a conductive agent present in the vicinity of the surface of a protrusion is suppressed. As a result, the resistance in the vicinity of the surface of a protrusion can be stabilized, discharge can be stabilized, and generation of the streaked image due to abnormal discharge can be suppressed.

Furthermore, the inventors of the present invention have presumed that the quasi-bilayer structure corresponds to the structure of an anti-vibration rubber in which two rubber layers having a different natural vibration frequency are laminated.

The loss in vibration by the anti-vibration rubber is described in pages 97 to 99 of "Anti-Vibration Rubber, New Edition" (Haruhiko Tohara and 10 other joint authors, new edition, The Japan Association of Rolling Stock Industries, Oct. 30, 1998). In particular, the following expression (1) showing a relationship between vibration transmissibility, and vibration frequency ratio ($\omega/\omega_n$) and attenuation ratio ($C/C_c$) is described as expression (7.6) in page 98 of the above document.

[Expression 1]

$$\text{Transmissibility} = \frac{\sqrt{1+\left(2\frac{c}{c_c}*\frac{\omega}{\omega_n}\right)^2}}{\sqrt{\left(1-\frac{\omega^2}{\omega_n^2}\right)^2+\left(2\frac{c}{c_c}*\frac{\omega}{\omega_n}\right)^2}} \quad (1)$$

When the vibration transmissibility is here considered with respect to the resin particle in the present invention, the vibration applied to the resin particle is represented as the ratio of the vibration transmitted from the region of the resin particle where is farther from the electro-conductive substrate, to the region of the resin particle where is closer to the electro-conductive substrate. That is, such a value corresponds to the value that reflects the degree of loss in vibration at the interface between the region 6 and the region 7 in the resin particle 4. In addition, the vibration frequency ratio represents the ratio, f6/f7 (hereinafter, also referred to the f6/f7 as "natural vibration frequency ratio"), of the natural vibration frequency f6 of the second region 6 of the resin particle where is farther from the electro-conductive substrate, to the natural vibration frequency f7 of the first region 7 of the resin particle where is closer to the electro-conductive substrate, and the attenuation ratio represents the attenuation ratio of the resin particle.

In order to lose the vibration applied to the resin particle, the vibration transmissibility is required to be less than 1.0. Thus, the pressure of the vibration can be lost at the interface in the quasi-bilayer structure, namely, at the interface of the second region 6 and the first region 7.

In order that the vibration transmissibility in expression (1) is less than 1.0, the vibration frequency ratio is required to be more than $\sqrt{2}$ regardless of the attenuation ratio. Thus, the vibration transmitted from the surface of the charging member can be lost. A vibration frequency ratio of more than $\sqrt{2}$ means a vibration frequency ratio of the resin particle of more than $\sqrt{2}$. Such a condition can be adopted in order that the loss in vibration by the interface in the quasi-bilayer structure of the resin particle is exhibited. A protrusion in the quasi-bilayer structure of the resin particle absorbs vibration to thereby suppress the vibration of the charging member as a whole.

The inventors of the present invention have made studies about a relationship between the porosities of the second region 6 and the first region 7 of the resin particle in order to adjust the vibration frequency ratio of the resin particle to more than $\sqrt{2}$. As a result, the inventors of the present invention have found that the relationship between the porosities of the second region 6 and the first region 7 of the resin particle can be adjusted to thereby adjust the natural vibration frequency ratio of the resin particle. Herein, the relationship between the porosities is described later.

<Resin Particle>

The volume average particle size of the resin particle in the present invention is preferably 5.0 μm or more and 50.0 μm or less, more preferably 10.0 μm or more and 40.0 μm or less, further preferably 15.0 μm or more and 40.0 μm or less. When the volume average particle size falls within such ranges, a protrusion in the surface of the charging member can be brought into contact with the electrophotographic photosensitive member at a point, allowing a high chargeability to be exhibited. In addition, the above selective deformation of the region of the resin particle where is closer to the substrate, can be more effectively exhibited to suppress deformation of the region of the resin particle where is closer to the member surface.

The mean pore size of a pore in the resin particle can be 10 nm or more and 100 nm or less. When the mean pore size falls within the range, the selective deformation of the region of the resin particle where is closer to the substrate, can be promoted, deformation of the region of the resin particle where is closer to the member surface, can be sufficiently suppressed, and resistance stability can be increased. The measurement method of the mean pore size is described later.

The value V1 is 2.0% by volume or more and 90.0% by volume or less, and the value V2 is 0.0% by volume or more and 20.0% by volume or less. When the V1 and V2 fall within the ranges (provided that V1>V2 is satisfied), the selective deformation of the region of the resin particle where is closer to the substrate, can be promoted and vibration can be more effectively absorbed by the resin particle 4, while the strength of the resin particle itself is maintained.

Furthermore, the relationship between the porosities of the first region 7 and the second region 6 of the resin particle is described.

The ratio of the volume of a portion other than a pore of the first region 7 to the volume of a solid region having no pores under assumption of the first region 7 as the solid region is defined as a first solid rate 7.

In addition, the ratio of the volume of a portion other than a pore of the second region 6 to the volume of a solid region having no pores under assumption of the second region 6 as the solid region is defined as a second solid rate 6.

The ratio of the second solid rate 6 to the first solid rate 7 ([second solid rate 6/first solid rate 7], hereinafter, also referred to as "solid rate ratio") can be 1.1 or more, in particular, can be 2.0 or more. When the solid rate ratio falls within the ranges, the selective deformation of the region of the resin particle where is closer to the substrate, can be promoted and deformation of the region 6 can be effectively suppressed.

Furthermore, from the viewpoint of the loss in vibration by the resin particle, the porosity V1 of the first region 7 is preferably 56% by volume or more and 90% by volume or less and the porosity V2 of the second region 6 is preferably 0% by volume or more and 5% by volume or less. When the porosities of the respective regions fall within the respective ranges, the natural vibration frequency ratio of the resin particle can be $\sqrt{2}$ or more and the vibration transmissibility of the resin particle can be reduced. Thus, vibration externally transmitted to a protrusion of the charging member can be more effectively lost.

The measurement method of the porosities of the resin particle is described later.

<Surface Layer>

[Binder Resin]

The binder resin for use in the surface layer in the present invention is not particularly limited, and, for example, a known resin can be used as the binder resin. Examples of the binder resin can include the following: at least one resin selected from a urethane resin, an acrylic resin and a polyamide resin. Such resins can be used from the viewpoints of controlling adhesion to the electrophotographic photosensitive member, friction properties, and affinity with and adhesion to the resin particle added into the surface layer. Such resins may be used alone or as a mixture of two or more. Moreover, a copolymer obtained by subjecting monomers as raw materials for such binder resins to copolymerization may also be used for the binder resin.

The surface layer may be formed by adding a crosslinking agent and the like to a prepolymer as the raw material of the binder resin, and curing or crosslinking the prepolymer.

Other layer may also be formed on the surface layer as long as the effects of the present invention are not impaired.

[Resin Particle]

Examples of the resin particle contained in the electro-conductive surface layer include a particle containing any macromolecular compound below:

at least one resin selected from resins such as an acrylic resin, a styrene resin, a styrene acrylic resin, a polyamide resin, a silicone resin, a vinyl chloride resin, a vinylidene chloride resin, an acrylonitrile resin, a fluororesin, a phenol resin, a polyester resin, a melamine resin, a urethane resin, an olefin resin, an epoxy resin, and copolymers, modified products and derivatives thereof, as well as thermoplastic elastomers such as an ethylene-propylene-diene rubber (EPDM), a styrene-butadiene rubber (SBR), a silicone rubber, a urethane rubber, an isoprene rubber (IR), a butyl rubber, a chloroprene rubber (CR), a polyolefin thermoplastic elastomer, a urethane thermoplastic elastomer, a polystyrene thermoplastic elastomer, a fluoro-rubber thermoplastic elastomer, a polyester thermoplastic elastomer, a polyamide thermoplastic elastomer, a polybutadiene thermoplastic elastomer, an ethylene vinyl acetate thermoplastic elastomer, a polyvinyl chloride thermoplastic elastomer and a chlorinated polyethylene thermoplastic elastomer.

Such resin particles are easily dispersed in the binder resin. From the viewpoint that a protrusion in the surface of the charging member (the surface of the surface layer) is brought into point contact with the electrophotographic photosensitive member to easily maintain a gap for exhibiting a high chargeability in all environments, a resin particle made of any of the following resins can be adopted:

an acrylic resin, a styrene resin, a styrene acrylic resin, a polyamide resin, a silicone resin, a vinyl chloride resin, a vinylidene chloride resin, an acrylonitrile resin, a fluororesin, a urethane resin or an epoxy resin.

The resin particle may be used alone or in combination of two or more. The resin particle may be subjected to a surface treatment, modification, introduction of a functional group or a molecular chain, coating or the like.

The resin particle can be spherical. For example, a spherical resin particle can be obtained by suspension polymerization, emulsion polymerization or the like.

The content of the resin particle in the surface layer is preferably 2 parts by mass or more and 100 parts by mass or less, more preferably 5 parts by mass or more and 80 parts by mass or less based on 100 parts by mass of the binder resin. When the content falls within the ranges, the above high chargeability by point contact can be more stably achieved.

The resin particle that generates a protrusion in the surface of the charging member is required to satisfy the following requirements, as described above.

(1) the resin particle has a pore inside thereof.

(2) the resin particle has a porosity Vt of 1.5% by volume or more and 45.0% by volume or less. In addition, the first region of the resin particle has a porosity V1 of 2.0% by volume or more and 90.0% by volume or less. Moreover, the second region of the resin particle has a porosity V2 of 0.0% by volume or more and 20.0% by volume or less.

(3) V1 is larger than V2.

In order that the resin particle is present in the surface layer, a porous resin particle can be used for the resin particle as a raw material that is to be contained in the surface layer (hereinafter, also referred to as "raw material resin particle"). Herein, the porous resin particle is defined as a resin particle having a large number of micropores penetrating through the surface thereof.

Hereinafter, the porous resin particle used for the resin particle is described in detail.

(Porous Resin Particle)

Examples of the material of the porous resin particle include an acrylic resin, a styrene resin, an acrylonitrile resin, a vinylidene chloride resin and a vinyl chloride resin. The particles made of such resins can be used for the resin particle alone or in combination of two or more. A copolymer obtained by subjecting monomers as raw materials for such resins to copolymerization may also be used for the porous resin particle. The porous resin particle may contain any of such resins as a main component and other known resin or additive if necessary. Such resins have a high affinity with the binder resin in the surface layer in the present invention, and therefore are easily dispersed in the binder resin. Moreover, such resins increase the adhesion of the binder resin with the resin particle, and are suitable for adjusting deformation properties of a protrusion of the resin particle which is in the region closer to the substrate.

Furthermore, from the viewpoint of easily maintaining a gap for exhibiting a high chargeability in all environments, the gap formed between the surface of the charging member and the surface of the electrophotographic photosensitive member by point contact of a protrusion formed in the surface of the surface layer with the electrophotographic photosensitive member, the resin particle made of the following resin can be adopted: at least one resin selected from an acrylic resin, a styrene resin and a styrene acrylic resin.

The porous resin particle can be produced by a known production method such as a suspension polymerization method, an interface polymerization method, an interface precipitation method, a liquid drying method, and a method in which a solute or solvent for reducing the solubility of a resin is added to a resin solution to precipitate the resin. For example, in the suspension polymerization method, a porosifying agent is dissolved in a polymerizable monomer in the presence of a crosslinkable monomer to prepare an oily mixed solution. The oily mixed solution can be used to perform aqueous suspension polymerization in an aqueous medium containing a surfactant and a dispersion stabilizer, and after the polymerization, perform washing and drying steps to thereby remove water and the porosifying agent, providing the resin particle. Herein, a compound having a reactive group that reacts with a functional group of the polymerizable monomer, an organic filler or the like can also be added. In order to form a micropore inside of the porous resin particle, the polymerization can be performed in the presence of the crosslinkable monomer.

Examples of the polymerizable monomer include the following: styrene monomers such as styrene, p-methyl styrene and p-tert-butyl styrene; and (meth)acrylic acid ester monomers such as methyl acrylate, ethyl acrylate, propyl acrylate, butyl acrylate, 2-ethylhexyl acrylate, lauryl acrylate, methyl methacrylate, ethyl methacrylate, propyl methacrylate, butyl methacrylate, isobutyl methacrylate, tert-butyl methacrylate, benzyl methacrylate, phenyl methacrylate, isobornyl methacrylate, cyclohexyl methacrylate, glycidyl methacrylate, hydrofurfuryl methacrylate and lauryl methacrylate. Such polymerizable monomers may be used alone or in combination of two or more. In the present invention, the term "(meth) acrylic" is a concept including both acrylic and methacrylic groups.

The crosslinkable monomer is not particularly limited as long as the crosslinkable monomer has a plurality of vinyl groups, and examples thereof can include: (meth)acrylic acid ester monomers such as ethylene glycol di(meth)acrylate, diethylene glycol di(meth)acrylate, triethylene glycol di(meth)acrylate, decaethylene glycol di(meth)acrylate, pentadecaethylene glycol di(meth)acrylate, pentacontahectaethylene glycol di(meth)acrylate, 1,3-butylene glycol di(meth) acrylate, 1,4-butanediol di(meth)acrylate, 1,6-hexanediol di(meth)acrylate, glycerol di(meth)acrylate, allyl(meth)acrylate, trimethylolpropane tri(meth)acrylate, pentaerythritol tetra(meth)acrylate, phthalic acid di[ethylene glycol(meth) acrylate], caprolactone-modified dipentaerythritol hexa(meth)acrylate, caprolactone-modified hydroxy pivalic acid ester, neopentyl glycol diacrylate, polyester acrylate and urethane acrylate, as well as divinylbenzene and divinylnaphthalene, and derivatives thereof. Such monomers may be used alone or in combination of two or more. In the present invention, the term "(meth)acrylate" is a concept including both acrylate and methacrylate.

The content of the crosslinkable monomer can be 5% by mass or more and 90% by mass relative to the total monomer. When the content falls within the range, a micropore can be effectively formed inside of the porous resin particle.

As the porosifying agent, a non-polymerizable solvent, a mixture of a linear polymer dissolved in a mixture of the polymerizable monomers with a non-polymerizable solvent, or a cellulose resin can be used. Examples of the non-polymerizable solvent can include the following: toluene, benzene, ethyl acetate, butyl acetate, normal hexane, normal octane and normal dodecane. The cellulose resin is not particularly limited, and examples thereof can include ethyl cellulose. Such porosifying agents may be used alone or in combination of two or more. The amount of the porosifying agent to be added can be appropriately selected depending on the intended use, and can be 20 parts by mass or more and 90 parts by mass or less based on the total amount of 100 parts by mass of the polymerizable monomer, the crosslinkable monomer and the porosifying agent. When the amount of the porosifying agent to be added falls within the range, the porous resin particle is hardly fragile, and point contact of the charging member with the electrophotographic photosensitive member is easily maintained.

A polymerization initiator is not particularly limited, and an initiator that can be dissolved in the polymerizable monomer can be adopted. As the polymerization initiator, for example, a known peroxide initiator or azo initiator can be used, and examples can include the following: 2,2'-azobisisobutyronitrile, 1,1'-azobiscyclohexane-1-carbonitrile, 2,2'-azobis-4-methoxy-2,4-dimethylvaleronitrile and 2,2'-azobis-2,4-dimethylvaleronitrile. Such polymerization initiators may be used alone or in combination of two or more.

Examples of the surfactant can include the following: anionic surfactants such as sodium lauryl sulfate, polyoxyethylene (degree of polymerization: 1 to 100) sodium lauryl sulfate and polyoxyethylene (degree of polymerization: 1 to 100) lauryl sulfate triethanolamine; cationic surfactants such as stearyl trimethyl ammonium chloride, stearic acid diethylaminoethylamide lactic acid salt, dilaurylamine hydrochloride and oleylamine lactic acid salt; nonionic surfactants such as adipic acid diethanol amine condensate, lauryldimethylamine oxide, glycerol monostearate, sorbitan monolaurate and stearic acid diethylaminoethylamide lactic acid salt; amphoteric surfactants such as palm oil fatty acid amide propyl dimethyl amino acetic acid betaine, lauryl hydroxysulfobetaine and sodium β-laurylaminopropionate; and high molecular dispersants such as polyvinyl alcohol, starch and carboxymethylcellulose. Such surfactants may be used alone or in combination of two or more.

Examples of the dispersion stabilizer can include the following: organic fine particles such as a polystyrene fine particle, a polymethyl methacrylate fine particle, a polyacrylic acid fine particle and a polyepoxide fine particle; silicas such as colloidal silica; and calcium carbonate, calcium phosphate, aluminum hydroxide, barium carbonate and magnesium hydroxide. Such dispersion stabilizers may be used alone or in combination of two or more.

Among the polymerization methods, a specific example of the suspension polymerization method is described below. The suspension polymerization can be performed using a pressure-resistant container under sealing. Prior to the polymerization, the raw material component may be suspended by a dispersing machine or the like, and the resulting suspension may be transferred to a pressure-resistant container and subjected to the suspension polymerization; or may be suspended in a pressure-resistant container. The polymerization temperature may be 50° C. or higher and 120° C. or lower. The polymerization can be performed under an atmospheric pressure, and, in order to prevent the porosifying agent from being gasified, the polymerization can be performed under increased pressure (under a pressure of atmospheric pressure plus 0.1 to 1 MPa). After the polymerization is completed, solid liquid separation, washing and the like may be performed by centrifugation, filtering or the like. After solid liquid separation and washing, the resultant may be dried or crushed at a temperature equal to or lower than the softening temperature of the resin that forms the resin particle. Such drying and crushing can be performed by a known method, and an air dryer, a fair wind dryer, a Nauta Mixer or the like can be used. Such drying and crushing can be performed at the same time by a crusher dryer or the like. The surfactant and the dispersion stabilizer can be removed by repeating washing and filtering or the like after production.

The particle size of the porous resin particle can be adjusted according to the mixing conditions of the oily mixed solution including the polymerizable monomer and the porosifying agent with the aqueous medium containing the surfactant and the dispersion stabilizer, the amount of the dispersion stabilizer or the like to be added, and stirring and dispersing conditions. When the amount of the dispersion stabilizer to be added is increased, the average particle size can be decreased. When the stirring rate is increased in the stirring and dispersing conditions, the average particle size of the porous resin particle can be decreased. The volume average particle size of the porous resin particle is preferably 5.0 μm or more and 50.0 μm or less, further preferably 10.0 μm or more and 40.0 μm or less. When the volume average particle size of the porous resin particle falls within the ranges, the charging member and the electrophotographic photosensitive member can be brought into point contact with each other to impart a high chargeability, and the selective deformation of the region of the resin particle where is closer to the substrate, can be more effectively performed.

The microporosity of the porous resin particle can be adjusted by the amount of the crosslinkable monomer to be added, the amount of the porosifying agent to be added based on the amounts of the polymerizable monomer and the crosslinkable monomer to be added, and the like. The microporosity of the porous resin particle means the ratio of the total volume of a micropore portion to the volume of the porous resin particle including a micropore.

The micropore size of the porous resin particle can be adjusted according to the type and the amount of the crosslinkable monomer to be added, stirring and dispersing conditions, and the like. In particular, the type of the crosslinkable monomer can be selected according to the affinity with the aqueous medium. In order to further increase the micropore size, a cellulose resin can be used as the porosifying agent.

The micropore size of the porous resin particle can be 10 nm or more and 200 nm or less. When the micropore size of the porous resin particle falls within the range, the pore size of the resin particle in formation of the surface layer can be easily adjusted within the above range.

The porous resin particle may be used alone or in combination of two or more. The porous resin particle may be subjected to a surface treatment, modification, introduction of a functional group or a molecular chain, coating, and the like.

As the porous resin particle, a particle may be used in which the porosity of the outer periphery of the resin particle is larger than the porosity of the central portion of the resin particle and the micropore size of the inside is larger than the micropore size of the outside. Such a porous resin particle can be produced by using two porosifying agents, in particular, two porosifying agents having a different solubility parameter (hereinafter, "SP value").

As a specific example, a production method of a porous resin particle in which normal hexane and ethyl acetate are used as the porosifying agents is described below. When the two porosifying agents are used, the oily mixed solution of the polymerizable monomer and the porosifying agents mixed is loaded to an aqueous medium, to thereby allow a large amount of ethyl acetate having an SP value close to the SP value of water used as a medium to be present closer to the aqueous medium, namely, in the outer periphery of a suspension droplet. On the contrary, a large amount of normal hexane is present in the central portion of the droplet. The ethyl acetate present in the outer periphery of the droplet has an SP value close to the SP value of water and therefore water is dissolved in the ethyl acetate in a certain amount. In such a case, the solubility of the porosifying agent in the polymerizable monomer is reduced and the polymerizable monomer is easily separated from the porosifying agent in the outer periphery of the droplet as compared with the central portion of the droplet. That is, the porosifying agent is easily present as a large bulk in the outer periphery of the droplet as compared with the central portion of the droplet. Thus, the reaction system is controlled so that the porosifying agent is present differently in the central portion and in the outer periphery of the droplet. The above polymerization reaction, and further a post-treatment and the like can be performed in such a state to thereby produce the above porous resin particle in which the microporosity of the outer periphery of the resin particle is larger than the microporosity of the central portion of the resin particle and the micropore size of the outer periphery is larger than the micropore size of the central portion.

Accordingly, a porosifying agent having an SP value close to the SP value of water for use as the medium can be used as one of the two porosifying agents to thereby increase the micropore size of the outside of the porous resin particle and increase the microporosity of the outside of the porous resin particle. Examples of the porosifying agent for use in the above method can include ethyl acetate, methyl acetate, propyl acetate, isopropyl acetate, butyl acetate, acetone and methyl ethyl ketone. Moreover, a porosifying agent having a high solubility in the polymerizable monomer and having an SP value farther from the SP value of water can be used as the other of the two porosifying agents to thereby decrease the micropore size of the inside of the porous resin particle and decrease the porosity of the inside of the porous resin particle. Examples of the porosifying agent for use in the above method can include normal hexane, normal octane and normal dodecane.

The regions having a different micropore size can be controlled by the ratio of the porosifying agents used.

[Electro-Conductive Fine Particle]

In order to impart conductivity to the surface layer in the present invention, the surface layer can contain a known electro-conductive fine particle.

Examples of the electro-conductive fine particle can include the following: metallic fine particles and fibers of aluminum, palladium, iron, copper and silver; metal oxides such as titanium oxide, tin oxide and zinc oxide; composite particles obtained by subjecting the metallic fine particles, fibers and metal oxides to a surface treatment with electrolysis processing, spray coating, or mixing and shaking; and carbon black and carbon fine particles. Such electro-conductive fine particles may be used alone or in combination of two or more.

The average particle size of the electro-conductive fine particle is preferably 0.01 μm or more and 0.9 μm or less, more preferably 0.01 μm or more and 0.5 μm or less. When the average particle size of the electro-conductive fine particle falls within the ranges, the volume resistivity of the surface layer is easily controlled.

The amount of the electro-conductive fine particle to be added to the surface layer is preferably 2 parts by mass or more and 200 parts by mass or less, more preferably 5 parts by mass or more and 100 parts by mass or less based on 100 parts by mass of the binder.

The electro-conductive fine particle may be subjected to a surface treatment. Examples of a surface treatment agent include the following: organic silicon compounds such as alkoxysilane, fluoroalkylsilane and polysiloxane; various coupling agents such as silane, titanate, aluminate and zirconate coupling agents; and oligomer and high molecular compounds. Such agents may be used alone or in combination of two or more.

[Other Components in Surface Layer]

A surface layer of the present embodiment may contain an ionic conductive agent and an insulation particle, in addition to the above electro-conductive fine particle.

Examples of the ionic conductive agent include the following: inorganic ion substances such as lithium perchlorate, sodium perchlorate and calcium perchlorate; cationic surfactants such as lauryl trimethylammonium chloride, stearyl trimethylammonium chloride, octadecyl trimethylammonium chloride, dodecyl trimethylammonium chloride, hexadecyl trimethylammonium chloride, trioctyl propylammonium bromide and modified aliphatic dimethylethylammonium ethosulfate; amphoteric ion surfactants such as lauryl betaine, stearyl betaine and dimethylalkyllauryl betaine; quaternary ammonium perchlorates such as tetraethylammonium perchlorate, tetrabutylammonium perchlorate and trimethyloctadecylammonium perchlorate; and organic acid lithium salts such as lithium trifluoromethanesulfonate. Such agents may be used single or in combination of two or more.

Examples of the insulation particle include the following: zinc oxide, tin oxide, indium oxide, titanium oxide (such as titanium dioxide and titanium monooxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminum hydroxide, magnesium hydroxide, zeolite, wollastonite, diatomite, glass beads, bentonite, montmorillonite, hollow glass ball, organometallic compound and organometallic salt particles; iron oxides such as ferrite, magnetite and hematite, and activated carbon; and high molecular compound particles. Such particles may be used alone or in combination of two or more.

[Method of Forming Surface Layer]

The surface layer can be formed by coating with a paint by a coating method such as electrostatic spray coating, dipping coating or ring coating.

In use of such a coating method, a coating solution is prepared in which the electro-conductive fine particle, the raw material resin particle and the like are dispersed in the binder resin. The coating solution can contain a solvent in order to easily control the above porosity. The solvent may be any solvent that can dissolve the binder resin. A polar solvent having a high affinity with the resin particle can be used.

Specifically, examples of the solvent can include ketones such as acetone, methyl ethyl ketone, methyl isobutyl ketone and cyclohexanone, alcohols such as methanol, ethanol and isopropanol, amides such as N,N-dimethylformamide and N,N-dimethylacetamide, sulfoxides such as dimethyl sulfoxide, ethers such as tetrahydrofuran, dioxane and ethylene glycol monomethyl ether, and esters such as methyl acetate and ethyl acetate.

The method of dispersing the binder resin, the conductive agent, the resin particle and the like in the coating solution is not particularly limited, and, for example, a known solution dispersing method using a ball mill, a sand mill, a paint shaker, a DYNO-MILL, a pearl mill or the like can be used.

When the porous resin particle is dispersed as the raw material resin particle in the coating solution, the porous resin particle can be impregnated with the solvent. Such impregnation is conducted for inhibiting the binder from penetrating into a micropore of the porous resin particle in dispersing of the porous resin particle in the coating solution. In the present invention, in order to enhance adhesion of the binder resin to the resin particle in the surface layer, a binder resin and a resin particle that are high in affinity with each other can be used. In such a case, the binder easily penetrates into a micropore of the porous resin particle. Then, a micropore of the porous resin particle can be impregnated with the solvent in advance to allow the solvent used for impregnation to adjust penetration of the coating solution into the micropore. Furthermore, the atmosphere temperature in a drying/curing step to be performed after coating with the coating solution can be adjusted to adjust volatilization of the solvent, with which a micropore of the porous resin particle is impregnated, and penetration of the binder resin to the porous resin particle. As a result, penetration of the binder resin is suppressed in the surface layer, and a micropore maintained forms a pore. Such a pore is easily controlled in the state of being unevenly present which is in the region closer to the substrate, in the resin particle.

In order to more easily perform control of a pore, specifically, a surface layer forming coating solution can be prepared as follows.

A pore of the resin particle in the surface layer can be controlled by the affinity of the solvent in the coating solution with the solvent with which the porous resin particle is impregnated. As such an affinity between the solvents is lower, specifically, the difference in SP value is larger, the porosity of the resin particle in the surface layer can be increased. The reason is because the solvent can be thus selected to allow the solvent in the coating solution to be hardly admixed with the solvent, with which a micropore of the porous resin particle is impregnated, thereby inhibiting the coating solution from penetrating into a micropore of the porous resin particle in the coating solution.

The method of impregnating a micropore of the porous resin particle with the solvent is not particularly limited, and for example, a known method can be used. Examples include a method of immersing the porous resin particle in the solvent, a method of subjecting the porous resin particle to ultrasonic in the solvent, a method including introducing the porous resin particle to a container for pressure reduction, and adding the solvent thereto, and a method including immersing the porous resin particle in the solvent in a container and subjecting the porous resin particle and the solvent to pressure reduction. Among the methods, a method of impregnation with the solvent by pressure reduction can be adopted in order to impregnate the inside of a micropore of the porous resin particle with the solvent.

Specifically, a container is first filled with the porous resin particle and sealed, and thereafter a vacuum pump is operated for pressure reduction to evacuate the container. Thus, air, moisture and the like present in a micropore of the porous resin particle are removed. Next, a pressure reduction valve is closed to stop the vacuum pump and an on-off valve is opened with the vacuum state being kept, and the solvent is supplied to the container to immerse the porous resin particle in the solvent. Then, while the on-off valve is closed, a pressure value is opened to pressurize the inside of the container. Thus, a micropore of the porous resin particle is forced to be impregnated with the solvent, and thus the porous resin particle can be impregnated.

The resulting porous resin particle impregnated with the solvent can be dispersed in the coating solution by the above method, to prepare the coating solution.

The coating solution prepared is applied by the above method to form a coating. A drying/curing step of the coating formed can be adjusted to change the ratio of a micropore maintained in the resin particle which is in the region closer to the substrate, to a micropore maintained in the resin particle which is in the region closer to the member surface, allowing a pore of the resin particle to be unevenly present in the surface layer. In order to easily perform such control, the polar solvent having a high affinity with the porous resin particle is preferably used, and ketones and esters among the above solvents are further preferably used for the solvent in the coating solution.

Figure 3A:
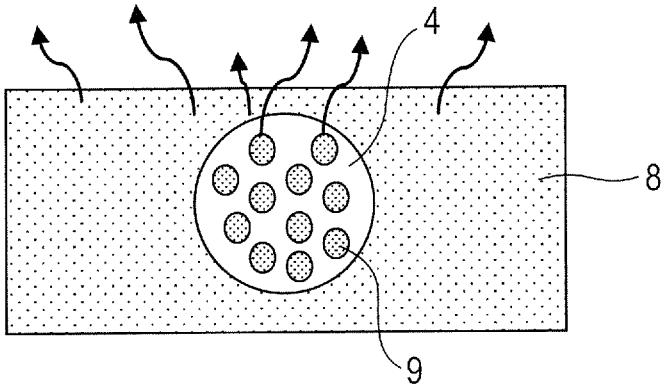
FIG. 3A, FIG. 3B and FIG. 3C each are an illustrative view of a production process of the charging member according to one aspect of the present invention.
Figure 3B:
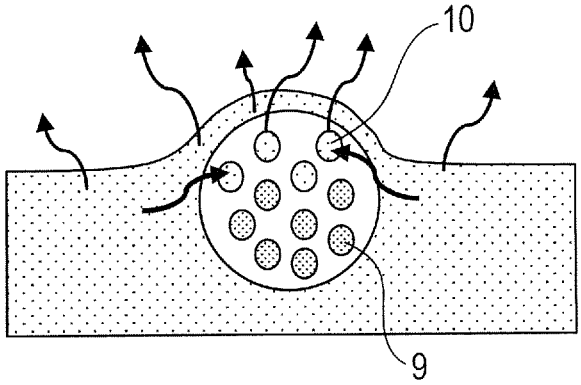
Figure 3C:
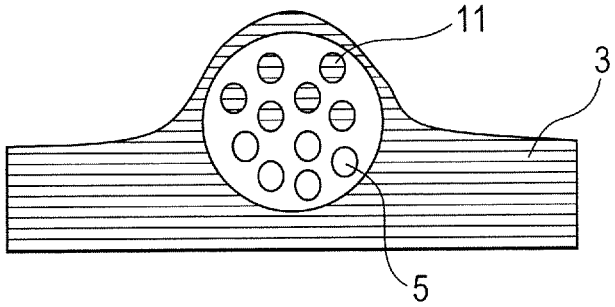

In a drying, curing or crosslinking step after formation of the coating, the temperature and the time can be controlled. The temperature and the time can be controlled to thereby control drying and moving of the solvents in the coating solution and the resin particle, and moving of the binder resin. Specifically, with respect to control of the step after formation of the coating, drying of the solvents can be performed at three or more steps. With reference to FIG. 3A to FIG. 3C, the case of a step including three steps after formation of the coating is described in detail below.

In a first step, after formation of the coating, the coating can be left as it is under a room temperature atmosphere for 15 minutes or more and 1 hour or less. As illustrated in FIG. 3A, the step allows a solvent in a coating 8 and also the solvent, with which a micropore of the porous resin particle is impregnated, to be mildly volatilized from the surface at the same time. The step inhibits defects due to bumping of the solvent from being caused in the subsequent drying/curing step.

In a second step, the resultant can be left to stand for 15 minutes or more and 1 hour or less with the atmosphere temperature being set at a temperature lower than the boiling point of the solvent with which the porous resin particle is impregnated. Specifically, the atmosphere temperature can be set at 40° C. or higher and 100° C. or lower depending on the type of the solvent used. In the step, as illustrated in FIG. 3B, the solvent in the coating and the solvent, with which a micropore of the porous resin particle is impregnated, are further volatilized from the surface. Moreover, as the solvent, with which the porous resin particle is impregnated, is further volatilized from the surface, the binder resin penetrates into a micropore of the porous resin particle which is in the region closer to the member surface. On the contrary, a micropore of the porous resin particle which is in the region closer to the electro-conductive substrate, is apart from the surface on which volatilization of the solvent progresses, and therefore the solvent in a micropore is slowly volatilized. Therefore, the solvent still remains in a micropore of the porous resin particle which is in the region closer to the electro-conductive substrate. On the other hand, as the solvent in the coating is gasified, the viscosity of the coating is increased and the solvent in a micropore of the porous resin particle which is in the region closer to the electro-conductive substrate, still remains, and therefore the binder resin in the coating hardly penetrates into a micropore of the porous resin particle which is located closer to the electro-conductive substrate. The binder resin in the coating here penetrates into a micropore 10 present in a region of the porous resin particle, farther from the electro-conductive substrate. Moreover, the solvent still remains in a micropore 9 present in a region of the porous resin particle where is closer to the electro-conductive substrate.

In a third step, the atmosphere temperature can be set at a temperature higher than the boiling points of the solvent, with which the porous resin particle is impregnated, and the solvent in the coating. The step includes drying, curing or crosslinking at a temperature equal to or higher than the boiling points of the solvents. In the step, the solvent in the coating is sufficiently volatilized as illustrated in FIG. 3C. In the step, the solvent in a micropore 9 of the porous resin particle, in the region closer to the electro-conductive substrate, is sufficiently volatilized to form a pore 5.

On the other hand, a micropore 10 of the porous resin particle, present in the region farther from the electro-conductive substrate, is filled with the binder resin to be in a state 11 where the micropore is clogged. As a result, a resin particle, in which a pore is unevenly present in the region closer to the electro-conductive substrate, is contained in the surface layer.

Control of the temperature in the second step to the temperature in the third step can be here conducted under a rapid temperature rise. Thus, a pore is easily formed in the region of the resin particle where is closer to the substrate. Specifically, the temperature in the second step can be controlled not in the same drying furnace as the drying furnace in the third step, but in a different apparatus or in a difference area from the apparatus or area in the third step, and movement between the respective apparatuses or areas can be performed in a time as short as possible.

That is, a method for producing a charging member of a preferred embodiment of the present invention includes:

(1) a step of impregnating a porous resin particle having a micropore with a first solvent;

(2) a step of coating the surface of an elastomer layer with a coating solution for surface layer formation, containing a binder resin, a second solvent, an electro-conductive particle and the porous resin particle impregnated with the first solvent, to form a coating;

(3) a step of volatilizing the first solvent and the second solvent in the coating to form a surface layer, wherein the step (3) includes at least (4) a step of replacing the first solvent in the micropore with the binder resin in a region of the porous resin particle where is closer to the member surface, and (5) a step of drying the coating at a temperature that is not less than the boiling point of the first solvent, with which the porous resin particle is impregnated, and that is not less than the boiling point of the second solvent in the coating.

A specific example of the method for forming the surface layer is described below.

First, dispersion components other than the resin particle, such as the electro-conductive fine particle, together with glass beads having a diameter of 0.8 mm are mixed with the binder resin, and the mixture is dispersed using a paint shaker dispersing machine. Next, a resin particle treated by the following method is added and dispersed. The dispersion time can be 2 minutes or more and 30 minutes or less. Here, conditions under which the resin particle is uniformly dispersed in the coating solution are required. Next, a coating is formed on an elastomer layer or the like by dip coating or the like. The coating is dried. Thereafter, a treatment such as curing or crosslinking may also be performed. Herein, the above dispersing procedure can be used for the method for dispersing the binder resin, the electro-conductive fine particle, the resin particle and the like in the coating solution.

The surface layer in the present invention is required to be a surface in which a protrusion by the resin particle is formed, and thus can be relatively thin. Specifically, the thickness of the surface layer is preferably 0.1 μm or more and 50 μm or less, more preferably 1.0 μm or more and 30 μm or less. Herein, the thickness of each layer can be measured by cutting out the cross section of the charging member by a sharp knife and observing the cross section with an optical microscope or an electron microscope.

The content of the resin particle in the surface layer is preferably 2 parts by mass or more and 100 parts by mass or less, more preferably 5 parts by mass or more and 50 parts by mass or less based on 100 parts by mass of the binder resin. When the content falls within the ranges, a protrusion by the resin particle can be more easily formed.

The formation of a protrusion can allow the surface state of the surface layer to be controlled as described below. The 10-point average roughness (hereinafter, referred to as "Rzjis") of the surface layer is preferably 5.0 μm or more and 65.0 μm or less, more preferably 10.0 μm or more and 50.0 μm or less. When the Rzjis falls within the ranges, the contact of the electrophotographic photosensitive member with a protrusion can be point contact to allow a high chargeability to be exhibited. The measurement method of the Rzjis of the surface is described later in detail.

The volume resistivity of the surface layer can be $1\times10^{2}$ Ω·cm or more and $1\times10^{16}$ Ω·cm or less in an environment of a temperature of 23° C. and a relative humidity of 50%. When the volume resistivity falls within the range, the electrophotographic photosensitive member is more easily charged properly by discharge.

The volume resistivity of the surface layer is determined as follows. First, the surface layer is cut out from the charging member to provide a strip having a length of 5 mm, a width of 5 mm and a thickness of 1 mm. A metal is deposited on both surfaces of the strip to produce an electrode and a guard electrode, providing a sample for measurement. If the surface layer is too thin to be cut out, an aluminum sheet is coated with the coating solution for surface layer formation to form a coating, and a metal is deposited on the surface of the coating to provide a sample for measurement. A voltage of 200 V is applied to the resulting sample for measurement using a microammeter (trade name: ADVANTEST R8340A ULTRA HIGH RESISTANCE METER, manufactured by Advantest Corporation). Then, after 30 seconds, the current is measured and the volume resistivity is determined from the film thickness and the area of the electrode by calculation. The volume resistivity of the surface layer can be adjusted by the electro-conductive fine particle and the ionic conductive agent described above.

In order to improve releasing properties, the surface layer may further contain a mold release agent. The surface layer can contain a mold release agent to thereby prevent dirt from adhering to the surface of the charging member, improving the durability of the charging member. When the mold release agent is a liquid, the mold release agent also acts as a leveling agent in formation of the surface layer.

The surface layer may be subjected to a surface treatment. The surface treatment can include a surface-processing treatment with an ultraviolet ray (UV), an electron beam (EB) or the like, and a surface-modifying treatment in which the surface is allowed to adhere to and/or to be impregnated with a compound.

<Electro-Conductive Substrate>

The electro-conductive substrate for use in the charging member of the present invention is a substrate having conductivity and having a function of supporting the surface layer or the like disposed thereon. Examples of the material thereof include metals such as iron, copper, stainless steel, aluminum and nickel, and alloys thereof. In order to impart scratch resistance to the surface of such a substrate, the surface may be subjected to a plating treatment as long as conductivity is not impaired. Furthermore, as the electro-conductive substrate, a resin substrate whose surface is covered with a metal to achieve surface electro-conductivity or a substrate produced from an electro-conductive resin composition can be used.

The electro-conductive substrate may be bonded to a layer disposed immediately thereon via an adhesive. In such a case, the adhesive can be electro-conductive. In order to impart conductivity, the adhesive can contain a known conductive agent.

The binder for the adhesive is not particularly limited, examples thereof include a thermosetting resin and a thermoplastic resin, and a known resin such as a urethane, acrylic, polyester, polyether or epoxy resin can be used.

The conductive agent for imparting conductivity to the adhesive can be appropriately selected from the electro-conductive fine particle and the ionic conductive agent, and can be used alone or in combination of two or more.

<Elastomer Layer>

In the charging member of the present invention, an elastomer layer may be formed between the electro-conductive substrate and the surface layer. The binder for use in the elastomer layer is not particularly limited, and a known resin or rubber can be used. Examples include a resin, a natural rubber and a vulcanized natural rubber, and a synthetic rubber. As the resin, a resin such as a thermosetting resin or a thermoplastic resin can be used. In particular, the resin can include a fluororesin, a polyamide resin, an acrylic resin, a polyurethane resin, a silicone resin and a butyral resin. The synthetic rubber includes an ethylene propylene diene rubber (EPDM), a styrene butadiene rubber (SBR), a silicone rubber, a urethane rubber, an isoprene rubber (IR), a butyl rubber, an acrylonitrile butadiene rubber (NBR), a chloroprene rubber (CR), an acrylic rubber and an epichlorohydrin rubber. Alternatively, examples include thermoplastic elastomers such as a styrene butadiene styrene block copolymer (SBS) and a styrene ethylene butylene styrene block copolymer (SEBS). Such resins and rubbers may be used alone or in combination of two or more.

In particular, a polar rubber can be used because being easy in resistance adjustment. In particular, the polar rubber can include an epichlorohydrin rubber and NBR. Such rubbers are advantageous because the resistance and the hardness of the elastomer layer are more easily controlled.

The volume resistivity of the elastomer layer can be $10^2$ Ω·cm or more and $10^{10}$ Ω·cm or less in an environment of a temperature of 23° C. and a relative humidity of 50%.

The volume resistivity of the elastomer layer can be adjusted by appropriately adding a conductive agent such as carbon black, a conductive metal oxide, an alkali metal salt or an ammonium salt into the binder. When the binder is a polar rubber, the ammonium salt can be particularly used. The elastomer layer can also contain an additive such as a softening oil or a plasticizer and the above insulation particle, in addition to the electro-conductive fine particle, in order to adjust hardness and the like. The elastomer layer can also be provided on the electro-conductive substrate, the surface layer and the like with being bonded thereto by an adhesive. As the adhesive, an electro-conductive adhesive can be used.

<Charging Member>

The charging member according to the present invention may have the electro-conductive substrate and the surface layer, and the shape thereof may be a roller shape or a planar shape. Hereinafter, a charging roller is used as an example of the charging member and described in detail.

The charging roller in the present invention can usually have an electric resistance value of $1\times10^3$ Ω·cm or more and $1\times10^{10}$ Ω·cm or less in an environment of a temperature of 23° C. and a relative humidity of 50% in order to improve charging of the electrophotographic photosensitive member.

Figure 4:
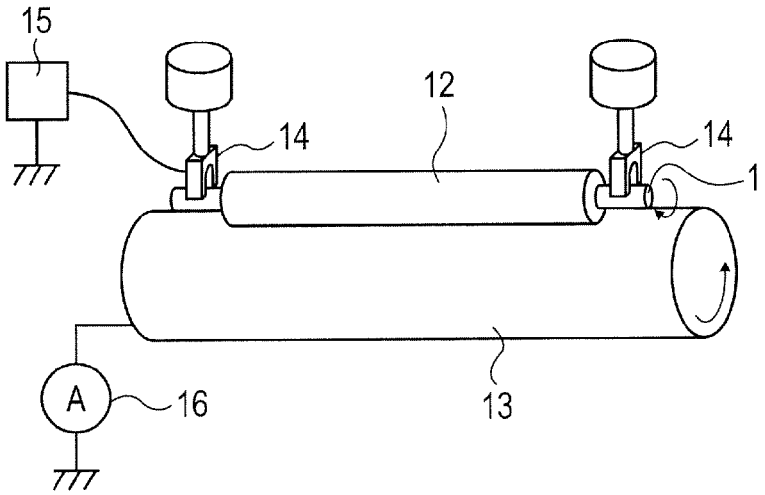
FIG. 4 is an illustrative view of a measurement apparatus of the electric resistance value of the charging member according to one aspect of the present invention.

FIG. 4 illustrates the method for measuring the electric resistance value of the charging roller. Both ends of an electro-conductive substrate 1 are allowed to abut with bearings 14, to which a load is applied, so as to be in parallel with a cylindrical metal 13 having the same curvature as the curvature of the electrophotographic photosensitive member by the bearings 14. The cylindrical metal 13 is rotated by a motor (not illustrated) in the state, and a DC voltage of −200 V is applied from a stabilized power supply 15 with the charging roller 12 abutting with the cylindrical metal 13 following the rotation of the cylindrical metal 13. The current flowing at the time is measured by an ammeter 16, and the resistance of the charging roller is calculated. In the present embodiment, each of the loads is 4.9 N, and the metal cylinder has a diameter of 30 mm and rotates at a circumferential speed of 45 mm/sec.

From the viewpoint that the charging roller in the present invention has a uniform nip width in the longitudinal direction to the electrophotographic photosensitive member, the charging roller can have a crown shape in which the central portion in the longitudinal direction is the thickest and the thickness is reduced toward both the ends in the longitudinal direction. With respect to the amount of the crown, the difference between the outer diameter of the central portion and the outer diameters at positions 90 mm apart from the central portion can be 30 μm or more and 200 μm or less.

<Process Cartridge>

Figure 5:
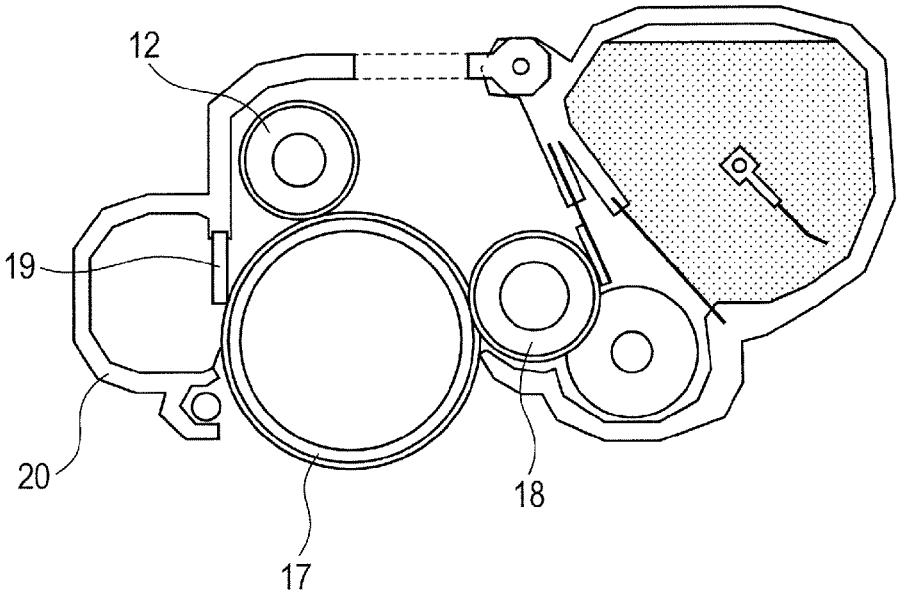
FIG. 5 is a sectional view of a process cartridge according to one aspect of the present invention.

FIG. 5 illustrates a process cartridge detachably mountable on the main body of an electrophotographic apparatus in which an electrophotographic photosensitive member 17, a charging apparatus having a charging roller 12, a developing apparatus having a developing roller 18, a cleaning apparatus provided with a cleaning blade 19, and the like are integrated. The charging member according to the present invention can be used as the charging apparatus. Reference numeral 20 in FIG. 5 denotes a recovering container. That is, a process cartridge is illustrated in which the charging member is at least integrated with a member to be charged and which is detachably mountable on the main body of the electrophotographic apparatus, wherein the charging member is the charging member according to the present invention.

<Electrophotographic Apparatus>

Figure 6:
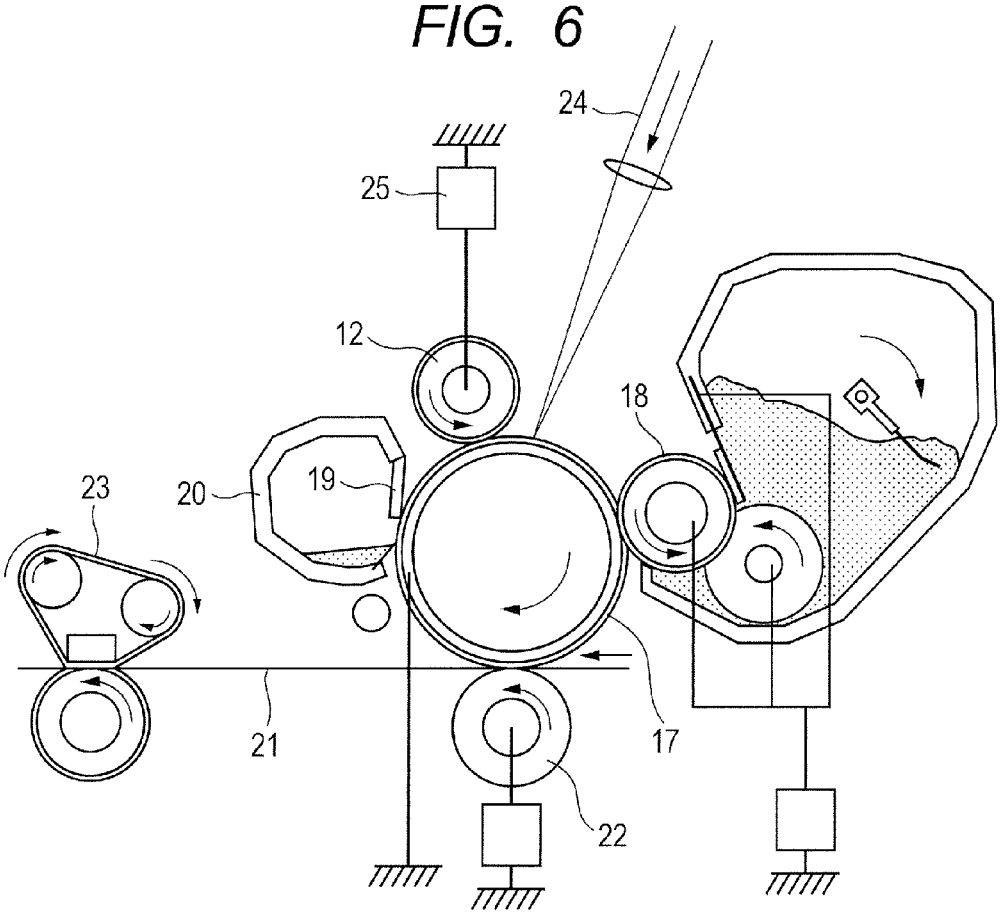
FIG. 6 is a sectional view of an electrophotographic image forming apparatus according to one aspect of the present invention.

FIG. 6 is a view illustrating a schematic configuration of one example of an electrophotographic apparatus provided with the charging member according to the present invention.

The electrophotographic apparatus includes an electrophotographic photosensitive member 17, a charging apparatus that charges the electrophotographic photosensitive member, a latent image forming apparatus 24 that performs exposure, a developing apparatus that develops a latent image to a toner image, a transfer apparatus that transfers the toner image to a transfer material, a cleaning apparatus that recovers a transferred toner on the electrophotographic photosensitive member, a fixing apparatus 23 that fixes the toner image, and the like.

The electrophotographic photosensitive member 17 is a rotary drum type member having a photosensitive layer on the electro-conductive substrate. The electrophotographic photosensitive member is rotary driven in the arrow direction at a predetermined circumferential speed (process speed).

The charging apparatus includes a contact type charging roller 12 that is contact disposed by abutting with the electrophotographic photosensitive member 17 at a predetermined pressing force. The charging roller 12 is rotated following the rotation of the electrophotographic photosensitive member 17, and charges the electrophotographic photosensitive member at a predetermined potential by application of a predetermined DC voltage from a charging power supply 25.

As the latent image forming apparatus 24 that forms an electrostatic latent image on the electrophotographic photosensitive member 17, for example, an exposure apparatus such as a laser beam scanner is used. An electrophotographic photosensitive member evenly charged is exposed in correspondence with image information, to thereby form an electrostatic latent image.

The developing apparatus includes a developing sleeve or a developing roller 18 disposed close to or in contact with the electrophotographic photosensitive member 17. A toner electrostatically treated so as to have the same polarity as the charging polarity of the electrophotographic photosensitive member is used to develop an electrostatic latent image by reversal development, forming a toner image.

The transfer apparatus includes a contact type transfer roller 22. The toner image is transferred from the electrophotographic photosensitive member to a transfer material 21 such as normal paper. The transfer material is conveyed by a sheet conveying system having a conveying member.

The cleaning apparatus includes a blade type cleaning member 19 and a recovering container 20, and after transfer, mechanically scrapes off and recovers the transfer remaining toner left on the electrophotographic photosensitive member.

Here, the cleaning apparatus can be eliminated by adopting a simultaneous developing and cleaning system in which the transfer remaining toner is recovered by the developing apparatus.

The fixing apparatus 23 includes a roll heated, and the like, and fixes the transferred toner image on the transfer material 21 and discharges the transfer material.

As described above, one aspect of the present invention can provide a charging member that suppresses vibration even when used in a contact charging system, and that can stably charge an electrophotographic photosensitive member. Moreover, vibration is suppressed to thereby suppress the variation in the resistance in the vicinity of the vertex of a protrusion in the surface of the charging member. In addition, a streaked image due to abnormal discharge of the charging member is also inhibited from being generated.

One aspect of the present invention can provide a process cartridge and an electrophotographic image forming apparatus useful for stable formation of a high-quality electrophotographic image.

EXAMPLES

Hereinafter, the present invention is described in more detail with reference to specific examples. First, evaluation methods in the present example are described below.

[1. Observation of Cross-Section of Resin Particle]

First, the porous resin particle is embedded using a photocurable resin such as a visible light-curable embedding resin (trade name: D-800, produced by Nisshin EM Corporation) or an epoxy resin (trade name: Epok812 set, produced by Okenshoji Co., Ltd.). Next, trimming is performed using an ultramicrotome (trade name: LEICA EM UCT, manufactured by Leica) in which a diamond knife (trade name: DiATOME-CRYO DRY, manufactured by DiATOME) is mounted, and a cryosystem (trade name: LEICA EM FCS, manufactured by Leica).

Then, the cross-section including the center of the porous resin particle is cut out to prepare a section having a thickness of 100 nm. Thereafter, any dyeing agent of osmium tetraoxide, ruthenium tetraoxide or phosphorus tungstate is used to perform a dyeing treatment, and the image of the cross-section of the porous resin particle is taken by a transmission electron microscope (trade name: H-7100FA, manufactured by Hitachi, Ltd.). The operation is performed on any 100 particles. The resin portion is observed whitely and the micropore portion is observed blackly. Herein, the resin that embeds the porous resin particle, and the dyeing agent are appropriately selected according to the material of the resin particle. A combination here is selected so that a micropore of the porous resin particle can be clearly confirmed. For example, a micropore of porous resin particle A1 produced in Production Example 1 below could be confirmed by observation using the visible light-curable embedding resin D-800 and ruthenium tetraoxide.

[2. Volume Average Particle Size of Resin Particle]

In the image of the cross-section of the particle obtained in [1] above, the total area of the resin particle including a micropore portion is calculated to determine the diameter of a circle having the same area as the total area. The volume average particle size is calculated from the resulting diameters of 100 particles in total. The resulting volume average particle size is defined as the volume average particle size of the resin particle.

[3. Average Microporosity of Resin Particle]

In the image of the cross-section of the particle obtained in [1] above, the ratio of the total area of a micropore portion to the total area of the resin particle including a micropore portion is calculated. The operation is performed on any 10 resin particles, and the average is calculated. The resultant is defined as the average microporosity of the resin particle.

[4. Mean Micropore Size of Resin Particle]

In the image of the cross-section of the particle obtained in [1] above, the diameter of a circle having the same area as the area of a micropore portion observed blackly at any one point is determined. The same manner is made to determine the diameters of circles having the same area as the area of a micropore portion at any 10 points. The operation is performed on any 10 resin particles, and the average is calculated. The resultant is defined as the mean micropore size of the resin particle.

[5. Measurement of Stereoscopic Resin Particle Shape of Particle Contained in Surface Layer]

Any protrusion in the surface of the charging member is cut out using a focused ion beam (trade name: FB-2000C, manufactured by Hitachi, Ltd.) so as to provide respective cross-sections parallel to the surface of the charging member by 20 nm from the vertex of the protrusion to the bottom of the protrusion. Then, the images taken of the respective cross-sections are overlapped at an interval of 20 nm in order from a cross-section closer to the vertex of the protrusion, to reproduce the stereoscopic shape of the resin particle forming the protrusion. The operation is performed on protrusions at any 100 points in the surface of the charging member, and the stereoscopic shape of the resin particle forming each protrusion is reproduced.

[6. Volume Average Particle Size of Resin Particle Contained in Surface Layer]

In the stereoscopic shape of the resin particle reproduced in [5] above, the total volume of the resin particle including a pore is calculated. The total volume is defined as the volume of the resin particle under assumption of the resin particle as a solid particle. The volume average particle size of the resin particle is calculated from the resulting volumes of 100 resin particles in total. The volume average particle size is defined as the volume average particle size of the resin particle contained in the surface layer.

[7. Measurement of Mean Pore Size of Resin Particle Contained in Surface Layer]

One pore portion is picked up from the stereoscopic particle shape obtained in [5] above, and the diameter of a sphere having the same volume as the volume of the one pore portion is calculated. Herein, the diameter is calculated about pore portions at 10 points per one resin particle. The operation is performed on any 10 resin particles, and the mean pore size of the resulting 100 diameters in total is calculated. The mean pore size is defined as the mean pore size of the resin particle contained in the surface layer.

[8. Measurement of Mean Porosities Vt, V1 and V2 of Resin Particle Contained in Surface Layer]

One resin particle is picked up from the stereoscopic particle shape obtained in [5] above, and the total volume of a pore of the resin particle is calculated. Then, the ratio of the total volume of a pore to the total volume of the resin particle including a pore is calculated. The operation is performed on any 100 resin particles, and the arithmetic mean value of the resulting 100 values in total is calculated. The resulting value is defined as the mean porosity Vt of the resin particle contained in the surface layer.

In measurement of the mean porosity Vt, a position is determined in which the volume of a solid particle under assumption of the resin particle as the solid particle is divided in half into the volume closer to the substrate and the volume closer to the member surface by a surface parallel to the surface of the charging member. In the resin particle, a region closer to the substrate relative to the position is defined as a first region of the resin particle. In addition, in the resin particle, a region farther from the substrate relative to the position is defined as a second region of the resin particle.

Then, the volume under assumption of the first region as a solid region having no pores (hereinafter, also referred to as "V1all") is determined. In the same manner, the volume under assumption of the second region as a solid region having no pores (hereinafter, also referred to as "V2all") is determined.

Next, the total volume of a pore present in the first region (hereinafter, also referred to as "V1pore") is determined. In addition, the total volume of a pore present in the second region (hereinafter, also referred to as "V2pore") is determined.

Then, the ratio (%) of V1pore to V1all is determined. In addition, the ratio (%) of V2pore to V2all is determined. The respective operations are performed on 100 resin particles contained in the surface layer, and the respective arithmetic mean values of the resulting values are defined as the porosity V1 of the first region and the porosity V2 of the second region of the resin particle contained in the surface layer.

Furthermore, the solid rate (first solid rate) of the first region and the solid rate (second solid rate) of the second region are calculated from the porosity V1 of the first region and the porosity V2 of the second region thus calculated, respectively, to calculate the solid rate ratio defined as "first solid rate/second solid rate".

[9. Measurement of Surface Roughness Rzjis of Charging Member]

The surface roughness Rzjis is measured using a surface roughness measuring apparatus (trade name: SE-3500, manufactured by Kosaka Laboratory Ltd.) according to the specification of surface roughness specified in JIS B 0601-2001. The Rzjis is measured at 6 points randomly selected in the charging member, and the average is represented as the Rzjis in the present invention. Herein, the cut-off value is 0.8 mm and the evaluation length is 8 mm.

Production Examples

Hereinafter, Production Examples 1 to 64 are described, and the respective Production Examples are as follows.

Production Examples 1 to 16 are each Production Example of resin particle. Production Examples 17 to 18 are Production Examples of unvulcanized rubber compositions R-1 to R-2, respectively. Production Examples 19 to 21 describe a treatment in which a micropore of each resin particle is impregnated with a solvent in order that the micropore is maintained even after surface layer formation and forms a pore. Production Example 22 is Production Example of composite electro-conductive fine particle. Production Example 23 is Production Example of titanium oxide particle surface-treated. Production Examples 24 to are each Preparation Example of surface layer forming coating solution.

Production Example 1

Production of Resin Particle A1

Eight parts by mass of calcium tertiary phosphate as a dispersion stabilizer was added to 400 parts by mass of deionized water to prepare an aqueous medium. Then, 39 parts by mass of methyl methacrylate as a polymerizable monomer, 26 parts by mass of diethylene glycol dimethacrylate as a crosslinkable monomer, 100 parts by mass of ethyl acetate as a porosifying agent and 0.3 parts by mass of 2,2'-azobisisobutyronitrile as a polymerization initiator were mixed to prepare an oily mixed solution. The oily mixed solution was dispersed in the aqueous medium at a number of rotations of 2500 rpm by a homomixer. Thereafter, the resultant was loaded to a polymerization reaction container purged with nitrogen, and subjected to suspension polymerization at 60° C. over 6 hours with stirring at 2500 rpm to provide an aqueous suspension including the porous resin particle and ethyl acetate. Four parts by mass of sodium lauryl sulfate as a surfactant was added to the aqueous suspension, and adjusted so that the concentration of sodium lauryl sulfate in 100 parts by mass of water was 1 part by mass.

The resulting aqueous suspension was distilled to remove ethyl acetate, and the remaining aqueous suspension was repeatedly subjected to filtering and washing with water, and then dried at 80° C. for 5 hours. The resultant was crushed and classified by a sonic classifier to provide resin particle A1 having a volume average particle size of 25.3 μm. The cross-section of the particle was observed by the above method, and resin particle A1 was found to be a porous resin particle having an average microporosity of 21% and a mean micropore size of 18 nm.

Production Examples 2 to 16

Production of Resin Particles A2 to A16

The type and number of part(s) of each of the polymerizable monomer, the crosslinkable monomer, the porosifying agent, the polymerization initiator, the dispersion stabilizer and the surfactant added, for use in the resin particle in each Production Example, and the stirring rate were set as recited in Tables 1 and 2. Each of resin particles A2 to A16 was produced by the same method as in Production Example 1 except for items other than the items recited in Table 1 and 2. Each of the resin particles produced was observed in the same manner as in Production Example 1, and the volume average particle size, the mean micropore size and the average microporosity after classification of each of the resulting resin particles were recited in Table 3.

TABLE 1

| Production Example No. | Resin particle No. | Polymerizable monomer 1 | Polymerizable monomer 2 | Crosslinkable monomer | Number of part(s) of polymerizable monomer 1 added, part(s) by mass | Number of part(s) of polymerizable monomer 2 added, part(s) by mass | Number of part(s) of crosslinkable monomer added, part(s) by mass |
|---|---|---|---|---|---|---|---|
| Production Example 1 | Resin particle A1 | Methyl methacrylate | — | Diethylene glycol dimethacrylate | 39 | — | 26 |
| Production Example 2 | Resin particle A2 | Methyl methacrylate | — | Diethylene glycol dimethacrylate | 39 | — | 26 |
| Production Example 3 | Resin particle A3 | Methyl methacrylate | — | Diethylene glycol dimethacrylate | 39 | — | 26 |
| Production Example 4 | Resin particle A4 | Methyl methacrylate | — | Diethylene glycol dimethacrylate | 39 | — | 26 |
| Production Example 5 | Resin particle A5 | Methyl methacrylate | — | Diethylene glycol dimethacrylate | 39 | — | 26 |
| Production Example 6 | Resin particle A6 | Methyl methacrylate | — | Diethylene glycol dimethacrylate | 39 | — | 26 |
| Production Example 7 | Resin particle A7 | Methyl methacrylate | — | Diethylene glycol dimethacrylate | 39 | — | 26 |
| Production Example 8 | Resin particle A8 | Methyl methacrylate | — | Diethylene glycol dimethacrylate | 39 | — | 26 |
| Production Example 9 | Resin particle A9 | Styrene | — | Divinylbenzene | 33 | — | 17 |
| Production Example 10 | Resin particle A10 | Methyl methacrylate | Styrene | Divinylbenzene | 20 | 20 | 25 |
| Production Example 11 | Resin particle A11 | Methyl methacrylate | — | Diethylene glycol dimethacrylate | 39 | — | 26 |
| Production Example 12 | Resin particle A12 | Methyl methacrylate | — | Diethylene glycol dimethacrylate | 39 | — | 26 |
| Production Example 13 | Resin particle A13 | Methyl methacrylate | — | Diethylene glycol dimethacrylate | 39 | — | 26 |
| Production Example 14 | Resin particle A14 | Methyl methacrylate | — | Diethylene glycol dimethacrylate | 39 | — | 26 |
| Production Example 15 | Resin particle A15 | Methyl methacrylate | — | Diethylene glycol dimethacrylate | 28 | — | 19 |
| Production Example 16 | Resin particle A16 | Methyl methacrylate | — | Diethylene glycol dimethacrylate | 32 | — | 22 |

TABLE 2

| Production Example No. | Resin particle No. | Porosifying agent 1 | Porosifying agent 2 | Polymerization initiator | Dispersion stabilizer | Surfactant | Number of part(s) of porosifying agent 1 added, part(s) by mass |
|---|---|---|---|---|---|---|---|
| Production Example 1 | Resin particle A1 | Methyl acetate | — | 2,2'-Azobisiso-butyronitrile | Calcium tertiary phosphate | Sodium lauryl sulfate | 97.5 |
| Production Example 2 | Resin particle A2 | Methyl acetate | — | 2,2'-Azobisiso-butyronitrile | Calcium tertiary phosphate | Sodium lauryl sulfate | 152 |
| Production Example 3 | Resin particle A3 | Methyl acetate | — | 2,2'-Azobisiso-butyronitrile | Calcium tertiary phosphate | Sodium lauryl sulfate | 152 |
| Production Example 4 | Resin particle A4 | Methyl acetate | — | 2,2'-Azobisiso-butyronitrile | Calcium tertiary phosphate | Sodium lauryl sulfate | 152 |
| Production Example 5 | Resin particle A5 | Methyl acetate | — | 2,2'-Azobisiso-butyronitrile | Calcium tertiary phosphate | Sodium lauryl sulfate | 152 |
| Production Example 6 | Resin particle A6 | Methyl acetate | — | 2,2'-Azobisiso-butyronitrile | Calcium tertiary phosphate | Sodium lauryl sulfate | 152 |
| Production Example 7 | Resin particle A7 | Isopropyl acetate | — | 2,2'-Azobisiso-butyronitrile | Calcium tertiary phosphate | Sodium lauryl sulfate | 152 |
| Production Example 8 | Resin particle A8 | Acetone | | 2,2'-Azobisiso-butyronitrile | Calcium tertiary phosphate | Sodium lauryl sulfate | 152 |
| Production Example 9 | Resin particle A9 | Methyl acetate | — | Benzoyl peroxide | Metathesis magnesium pyrophosphate | Sodium lauryl sulfate | 97.5 |

TABLE 2-continued

| | | | | | | | |
|---|---|---|---|---|---|---|---|
| Production Example 10 | Resin particle A10 | Normal hexane | — | Benzoyl peroxide | Polyvinyl alcohol (degree of saponification 85%) | Sodium dodecylbenzenesulfonate | 97.5 |
| Production Example 11 | Resin particle A11 | Methyl acetate | — | 2,2'-Azobisiso-butyronitrile | Calcium tertiary phosphate | Sodium lauryl sulfate | 218 |
| Production Example 12 | Resin particle A12 | Methyl acetate | — | 2,2'-Azobisiso-butyronitrile | Calcium tertiary phosphate | Sodium lauryl sulfate | 317 |
| Production Example 13 | Resin particle A13 | Methyl acetate | — | 2,2'-Azobisiso-butyronitrile | Calcium tertiary phosphate | Sodium lauryl sulfate | 477 |
| Production Example 14 | Resin particle A14 | Methyl acetate | — | 2,2'-Azobisiso-butyronitrile | Calcium tertiary phosphate | Sodium lauryl sulfate | 585 |
| Production Example 15 | Resin particle A15 | Normal hexane | Methyl acetate | 2,2'-Azobisiso-butyronitrile | Calcium tertiary phosphate | Sodium dodecylbenzenesulfonate | 46.1 |
| Production Example 16 | Resin particle A16 | Normal hexane | Isopropyl acetate | 2,2'-Azobisiso-butyronitrile | Calcium tertiary phosphate | Sodium dodecylbenzenesulfonate | 43.1 |

| Production Example No. | Number of part(s) of porosifying agent 2 added, part(s) by mass | Number of part(s) of polymerization initiator added, part(s) by mass | Number of part(s) of dispersion stabilizer added, part(s) by mass | Number of part(s) of surfactant added, part(s) by mass | Stirring rate/rpm |
|---|---|---|---|---|---|
| Production Example 1 | — | 0.3 | 8 | 4 | 2500 |
| Production Example 2 | — | 0.3 | 8 | 4 | 2500 |
| Production Example 3 | — | 0.3 | 8 | 4 | 4000 |
| Production Example 4 | — | 0.3 | 8 | 4 | 3000 |
| Production Example 5 | — | 0.3 | 8 | 4 | 1800 |
| Production Example 6 | — | 0.3 | 8 | 4 | 800 |
| Production Example 7 | — | 0.3 | 8 | 4 | 2500 |
| Production Example 8 | — | 0.3 | 8 | 4 | 2500 |
| Production Example 9 | — | 0.3 | 8 | 0.4 | 2500 |
| Production Example 10 | — | 0.3 | 8 | 0.4 | 3000 |
| Production Example 11 | — | 0.3 | 8 | 4 | 2500 |
| Production Example 12 | — | 0.3 | 8 | 4 | 2500 |
| Production Example 13 | — | 0.3 | 8 | 4 | 2500 |
| Production Example 14 | — | 0.3 | 8 | 4 | 2500 |
| Production Example 15 | 11.5 | 0.3 | 8 | 0.4 | 2500 |
| Production Example 16 | 10.8 | 0.3 | 8 | 0.4 | 2500 |

TABLE 3

| Production Example No. | Resin particle No. | Volume average particle size/μm | Mean micropore size/nm | Mean microporosity/% |
|---|---|---|---|---|
| Production Example 1 | Resin particle A1 | 25.3 | 18 | 21 |
| Production Example 2 | Resin particle A2 | 25.1 | 21 | 30 |
| Production Example 3 | Resin particle A3 | 15.2 | 20 | 30 |
| Production Example 4 | Resin particle A4 | 21.3 | 20 | 30 |
| Production Example 5 | Resin particle A5 | 32.1 | 21 | 33 |
| Production Example 6 | Resin particle A6 | 41.1 | 22 | 31 |
| Production Example 7 | Resin particle A7 | 25.4 | 14 | 32 |

TABLE 3-continued

| Production Example No. | Resin particle No. | Volume average particle size/μm | Mean micropore size/nm | Mean microporosity/% |
|---|---|---|---|---|
| Production Example 8 | Resin particle A8 | 25.6 | 32 | 30 |
| Production Example 9 | Resin particle A9 | 24.8 | 18 | 31 |
| Production Example 10 | Resin particle A10 | 25.1 | 17 | 22 |
| Production Example 11 | Resin particle A11 | 24.9 | 23 | 43 |
| Production Example 12 | Resin particle A12 | 24.9 | 25 | 52 |
| Production Example 13 | Resin particle A13 | 25.3 | 28 | 64 |
| Production Example 14 | Resin particle A14 | 25.2 | 30 | 67 |
| Production Example 15 | Resin particle A15 | 24.8 | 32 | 29 |

TABLE 3-continued

| Production Example No. | Resin particle No. | Volume average particle size/μm | Mean micropore size/nm | Mean microporosity/% |
|---|---|---|---|---|
| Production Example 16 | Resin particle A16 | 25.3 | 22 | 23 |

Production Example 17

Preparation of Unvulcanized Rubber Composition R-1 Using Epichlorohydrin Rubber

The following seven components were added to 100 parts by mass of an epichlorohydrin rubber (EO-EP-AGC ternary copolymer, EO/EP/AGE=73% by mol/23% by mol/4% by mol), and kneaded for 10 minutes in a sealed type mixer regulated at 50° C.

Calcium carbonate: 60 parts by mass
Aliphatic polyester plasticizer: 5 parts by mass
Zinc stearate: 1 part by mass
2-Mercaptobenzimidazole (MB) (anti-aging agent): 0.5 parts by mass
Zinc oxide: 5 parts by mass
Quaternary ammonium salt (trade name: Adekacizer LV70, produced by Adeka Corporation): 2 parts by mass
Carbon black (trade name: Thermax floform N990, produced by Cancarb Limited in Canada): 5 parts by mass Next, 1.2 parts by mass of sulfur as a vulcanizing agent, and 1 part by mass of dibenzothiazyl sulfide (DM) and 1 part by mass of tetramethyl thiuram monosulfide (TS) as vulcanization accelerators were added to the above mixture. The resultant was kneaded for 10 minutes in a two-roll mill cooled to a temperature of 20° C., to prepare unvulcanized rubber composition R-1.

Production Example 18

Preparation of Unvulcanized Rubber Composition R-2 Using Acrylonitrile Butadiene Rubber The following four components were added to 100 parts by mass of an acrylonitrile butadiene rubber (NBR) (trade name: N230SV, produced by JSR), and kneaded for 15 minutes in a sealed type mixer regulated at 50° C.

Carbon black (trade name: Tokablack #7360SB, produced by Tokai Carbon Co., Ltd.): 48 parts by mass
Zinc stearate (trade name: SZ-2000, produced by Sakai Chemical Industries Co., Ltd.): 1 part by mass
Zinc oxide (trade name: Zinc Oxide Type 2, produced by Sakai Chemical Industries Co., Ltd.): 5 parts by mass
Calcium carbonate (trade name: Silver W, produced by Shiraishi Kogyo): 20 parts by mass Next, 1.2 parts by mass of sulfur as a vulcanizing agent and 4.5 parts by mass of tetrabenzyl thiuram monosulfide (TBzTD) (trade name: Perkacit TBzTD, produced by Flexsys) as a vulcanization accelerator were added to the above mixture. The resultant was kneaded for 10 minutes in a two-roll mill cooled at a temperature of 25° C., to prepare unvulcanized rubber composition R-2.

Production Example 19

Treatment of Resin Particle J-1

The resin particle was placed in a container having a vacuum valve and a liquid injection valve, and the pressure in the container was reduced to 5 torr or less. Subsequently, the vacuum valve of the container was closed, and a solvent for impregnation was injected through the liquid injection valve of the container. The solvent was injected until the total of the resin particle was completely impregnated therewith.

Thereafter, the liquid injection valve was closed, the content of the container was purged with air to turn the pressure in the container to ordinary pressure, and thereafter the resin particle impregnated with the solvent was taken out. Thereafter, the solvent attached on the surface of the resin particle was removed by centrifugation. The resin particle was in the state where a micropore was favorably impregnated with the solvent. The amount of the solvent with which the resin particle was impregnated can be confirmed by head space GC-MS (trade name: TRACEGC ULTRA, manufactured by Thermo Fisher Scientific K.K.).

Production Example 20

Treatment of Resin Particle J-2

The resin particle was placed in a container until the whole of the resin particle was completely impregnated with a solvent. Ultrasonic vibration was applied thereto for 20 minutes. Thereafter, the resin particle impregnated with the solvent was taken out. Thereafter, the solvent attached on the surface of the resin particle was removed by centrifugation. The resin particle was favorably impregnated with the solvent.

Production Example 21

Treatment of Resin Particle J-3

The resin particle was placed in a container until the whole of the resin particle was completely impregnated with a solvent. The resultant was stirred using a mixer. Thereafter, the resin particle impregnated with the solvent was taken out. Thereafter, the solvent attached on the surface of the resin particle was removed by centrifugation. The resin particle was favorably impregnated with the solvent.

Production Example 22

Preparation of Composite Electro-Conductive Fine Particle

Methyl hydrogen polysiloxane (140 g) was added to 7.0 kg of a silica particle (average particle size: 15 nm, volume resistivity: $1.8\times10^{12}$ Ω·cm) while an edge runner was operated, and the resultant was mixed and stirred at a line load of 588 N/cm (60 kg/cm) for 30 minutes. The stirring rate here was 22 rpm. Carbon black (trade name: #52, produced by Mitsubishi Chemical Corporation) (7.0 kg) was added thereto over 10 minutes while an edge runner was operated, and the resultant was further mixed and stirred at a line load of 588 N/cm(60 kg/cm) for 60 minutes. Carbon black was thus allowed to adhere to the surface of the silica particle covered with methyl hydrogen polysiloxane, and thereafter dried using a dryer at 80° C. for 60 minutes to prepare a composite electro-conductive fine particle. The stirring rate here was 22 rpm. Herein, the resulting composite electro-conductive fine particle had an average particle size of 15 nm and a volume resistivity of $1.1\times10^{2}$ Ω·cm.

Production Example 23

Preparation of Titanium Oxide Particle Surface-Treated

Isobutyltrimethoxysilane (110 g) as a surface treatment agent and 3000 g of toluene as a solvent were blended with 1000 g of a needle-like rutile titanium oxide particle (average particle size: 15 nm, length:width=3:1, volume resistivity: $2.3\times10^{10}$ Ω·cm) to prepare a slurry. The slurry was mixed by a stirrer for 30 minutes, thereafter fed to a Visco mill where 80% of the effective inner volume was filled with glass beads having an average particle size of 0.8 mm, and wet crushed at a temperature of 35±5° C. The slurry obtained by such wet crushing was subjected to distillation under reduced pressure (bath temperature: 110° C., product temperature: 30 to 60° C., degree of pressure reduction: 100 Torr) for removal of toluene, and the surface treatment agent was baked at 120° C. for 2 hours. After the particle baked was cooled to room temperature, the particle was ground using a pin mill to prepare a titanium oxide particle surface-treated.

Production Example 24

Preparation of Surface Layer Forming Coating Solution T-1

Methyl isobutyl ketone was added to a caprolactone-modified acrylic polyol solution (trade name: Placcel DC2016, produced by Daicel Corporation) for preparation so that the solid content was 10% by mass. The following four components were added to 1000 parts by mass of the solution (acrylic polyol solid content: 100 parts by mass) to prepare a mixed solution.

Composite electro-conductive fine particle (particle prepared in Production Example 22): 45 parts by mass Titanium oxide particle surface-treated (particle prepared in Production Example 23): 20 parts by mass Modified dimethylsilicone oil (*1): 0.08 parts by mass Block isocyanate mixture (*2): 80.14 parts by mass The block isocyanate mixture here was added in an amount so that the amount of isocyanate satisfied "NCO/OH=1.0".

(*1) Modified dimethylsilicone oil (trade name: SH28PA, produced by Dow Corning Toray)

(*2) Mixture of hexamethylene diisocyanate (HDI) and isophorone diisocyanate (IPDI), each being a butanone oxime block, in a ratio of 7:3

The mixed solution (200 g), together with 200 g of glass beads as a medium having an average particle size of 0.8 mm, was placed in a glass bottle having an inner volume of 450 mL, and dispersed using a paint shaker dispersing machine for 24 hours to prepare surface layer pre-dispersion liquid A. Thereafter, 20 parts by mass of resin particle A13 treated by treatment method J-3 described in Production Example 21 was dispersed in 100 parts by mass of the acrylic polyol solid content in surface layer pre-dispersion liquid A for 5 minutes, and glass beads were removed to prepare surface layer forming coating solution T-1. In treatment J-3 here, methanol was used as the solvent with which the resin particle was impregnated.

Production Examples 25 to 64

Preparation of Surface Layer Forming Coating Solutions T-2 to T-41

Each of surface layer forming coating solutions T-2 to T-41 was prepared in the same manner as in Production Example 24 except that the type of the resin particle, the solvent for impregnation and the treatment method of the resin particle were changed to conditions shown in Table 4.

TABLE 4

| Production Example No. | Surface layer forming coating solution No. | Resin particle No. | Solvent for impregnation | Resin particle treatment method |
|---|---|---|---|---|
| Production Example 24 | T-1 | A13 | Methanol | J-3 |
| Production Example 25 | T-2 | A13 | Methanol | J-3 |
| Production Example 26 | T-3 | A14 | Methanol | J-1 |
| Production Example 27 | T-4 | A14 | Methanol | J-1 |
| Production Example 28 | T-5 | A14 | Methanol | J-1 |
| Production Example 29 | T-6 | A14 | Methanol | J-1 |
| Production Example 30 | T-7 | A12 | Isopropyl alcohol | J-1 |
| Production Example 31 | T-8 | A12 | Isopropyl alcohol | J-1 |
| Production Example 32 | T-9 | A12 | Isopropyl alcohol | J-1 |
| Production Example 33 | T-10 | A12 | Methanol | J-3 |
| Production Example 34 | T-11 | A13 | Isopropyl alcohol | J-1 |
| Production Example 35 | T-12 | A11 | Isopropyl alcohol | J-2 |
| Production Example 36 | T-13 | A11 | Isopropyl alcohol | J-2 |
| Production Example 37 | T-14 | A11 | Isopropyl alcohol | J-2 |
| Production Example 38 | T-15 | A11 | Isopropyl alcohol | J-2 |
| Production Example 39 | T-16 | A10 | Isopropyl alcohol | J-3 |
| Production Example 40 | T-17 | A10 | Isopropyl alcohol | J-3 |
| Production Example 41 | T-18 | A10 | Isopropyl alcohol | J-3 |
| Production Example 42 | T-19 | A10 | Isopropyl alcohol | J-3 |
| Production Example 43 | T-20 | A10 | Isopropyl alcohol | J-3 |
| Production Example 44 | T-21 | A2 | Methyl ethyl ketone | J-1 |
| Production Example 45 | T-22 | A7 | Methyl ethyl ketone | J-1 |
| Production Example 46 | T-23 | A8 | Methyl ethyl ketone | J-1 |
| Production Example 47 | T-24 | A15 | Methyl ethyl ketone | J-1 |
| Production Example 48 | T-25 | A2 | Methyl ethyl ketone | J-1 |
| Production Example 49 | T-26 | A15 | Methyl ethyl ketone | J-1 |
| Production Example 50 | T-27 | A2 | Methyl ethyl ketone | J-1 |
| Production Example 51 | T-28 | A3 | Methyl ethyl ketone | J-1 |
| Production Example 52 | T-29 | A4 | Methyl ethyl ketone | J-1 |

TABLE 4-continued

| Production Example No. | Surface layer forming coating solution No. | Resin particle No. | Solvent for impregnation | Resin particle treatment method |
|---|---|---|---|---|
| Production Example 53 | T-30 | A5 | Methyl ethyl ketone | J-1 |
| Production Example 54 | T-31 | A6 | Methyl ethyl ketone | J-1 |
| Production Example 55 | T-32 | A1 | Methyl ethyl ketone | J-3 |
| Production Example 56 | T-33 | A9 | Methyl ethyl ketone | J-3 |
| Production Example 57 | T-34 | A10 | Methyl ethyl ketone | J-3 |
| Production Example 58 | T-35 | A1 | Methyl ethyl ketone | J-3 |
| Production Example 59 | T-36 | A1 | Methyl isobutyl ketone | J-1 |
| Production Example 60 | T-37 | A1 | Methyl isobutyl ketone | J-1 |
| Production Example 61 | T-38 | A1 | Methyl isobutyl ketone | J-3 |
| Production Example 62 | T-39 | A15 | Methyl isobutyl ketone | J-3 |
| Production Example 63 | T-40 | A1 | Methyl isobutyl ketone | J-3 |
| Production Example 64 | T-41 | A16 | Methyl isobutyl ketone | J-3 |

Example 1

[Electro-Conductive Substrate]

A stainless substrate having a diameter of 6 mm and a length of 252.5 mm was coated with a thermosetting adhesive containing 10% by mass of carbon black, and dried to provide an electro-conductive substrate, and the electro-conductive substrate was used.

[Electro-Conductive Elastomer Layer]

An extrusion molding apparatus including a crosshead was used to coaxially cylindrically cover the electro-conductive substrate as the central shaft with unvulcanized rubber composition R-1 prepared in Production Example 28, to provide a pre-molded article having an outer diameter of 12.5 mm.

The pre-molded article was heated and vulcanized in a hot air furnace at 160° C. for 1 hour to form an electro-conductive covering layer on the outer circumference of the electro-conductive substrate. Ends of the electro-conductive covering layer were removed to provide a roller including an electro-conductive covering layer and having of a length of 224.2 mm.

Next, the outer peripheral surface of the electro-conductive covering layer was polished using a plunge cutting mode cylinder polisher to provide elastic roller D-1 having an electro-conductive elastomer layer and having an outer diameter of 12 mm and a length of 224.2 mm.

[Formation of Surface Layer]

Elastic roller D-1 was dip-coated with surface layer forming coating solution T-1 prepared in Production Example 24 once. After such coating, air-drying as drying in a first step was conducted at room temperature for 30 minutes or more, and drying in a second step was conducted at 60° C. for 1 hour and drying in a third step was further conducted at 160° C. for 1 hour in a hot air circulation dryer, to provide charging roller C-1 in which a surface layer was formed. Herein, dip-coating conditions are as follows. The immersion time was 9 seconds and the pull-up rate was as follow: the initial rate was 20 mm/s and the final rate of 2 mm/s, and the pull-up rate therebetween was linearly changed.

The volume average particle size, the mean pore size, the mean porosity, and the porosity measured closer to the member surface and the porosity measured closer to the substrate, as physical properties of the resin particle in the surface layer of charging roller C-1 produced, were evaluated by the above methods. The evaluation results are shown in Table 5. The surface roughness Rzjis of the surface of the charging roller, the vibration size of the charging roller, the electric resistances before and after endurance and the variation in electric resistance, as physical properties of the charging roller, were evaluated by the above methods. The evaluation results are shown in Table 6. Herein, measurements of the vibration size of the charging roller, the electric resistances before and after endurance, and the variation in electric resistance are described below. Herein, the drying temperature and the drying time correspond to the drying conditions in the seconds step in Table 5.

[Endurance Evaluation]

A monochrome laser printer (trade name: LBP6300, manufactured by Canon Inc.) being the electrophotographic image forming apparatus having the configuration illustrated in FIG. 6 was used, and a voltage was applied to the charging member from the outside. The voltage applied was as follows: with respect to the AC voltage, the peak to peak voltage was 1400 V and the frequency was 1350 Hz, and the DC voltage was −560 V. An image was output at a resolution of 600 dpi. Herein, a process cartridge for the above printer (trade name: Toner Cartridge 519II, manufactured by Canon Inc.) was used as the process cartridge.

The charging roller attached was detached from the process cartridge, and charging roller C-1 prepared was mounted. In addition, charging roller C-1 was allowed to abut with the electrophotographic photosensitive member by a spring at a pressing force of 4.9 N at one end thereof and a total pressing force of 9.8 N at both ends thereof. The process cartridge was adapted to an environment (temperature: 15° C./humidity: 10% RH; environment 1), an environment (temperature: 23° C./humidity: 50% RH; environment 2) and an environment (temperature: 30° C./humidity: 80% RH; environment 3) for 24 hours. Thereafter, an endurance test was performed in each of the environments.

Specifically, a 2-sheet intermittent endurance test (the printer was stopped and endured for 3 seconds every 2 sheets) was performed in which a horizontal line image of a width of 2 dots and an interval of 186 dots was output in the direction perpendicular to the rotation direction of the electrophotographic photosensitive member. A halftone image (image in which a horizontal line of a width of 1 dot and an interval of 2 dots was drawn in the direction perpendicular to the rotation direction of the electrophotographic photosensitive member) was output for evaluation at the initial stage and after completion of outputting for 10000 (10 K) sheets. Thereafter, charging roller C-1 was detached from the process cartridge subjected to the endurance test, and charging roller C-1 was mounted to a new process cartridge and the 2-sheet intermittent endurance test was performed for 10 K sheets. The operation was repeated, and the halftone image was output for evaluation at each of the time when outputting for 20000 (20 K) sheets in total from the initial stage was completed and the time when outputting for 30000 (30 K) sheets in total from the initial stage was completed. Herein, the evaluation was performed as follows: the halftone image was visually observed and the streaked image was rated according to the following criteria. The evaluation results are shown in Table 7.

Rank 1; the streaked image was not generated.

Rank 2; the streaked image was only slightly observed.

Rank 3; the streaked image was partially observed on the pitch of the charging roller, but was not problematic in practical use.

Rank 4; the streaked image was remarkable and the deterioration in image quality was observed.

[Measurement of Electric Resistance Value of Charging Roller]

In the endurance evaluation, the electric resistance of the charging roller used for formation of the electrophotographic image in "environment 2" above was calculated, and the change in electric resistance from the electric resistance of the charging roller before formation of the electrophotographic image was evaluated.

The electric resistance value of the charging roller was measured by the above method before and after the endurance evaluation. From the results, the ratio of the resistance after the endurance evaluation to the resistance before the endurance evaluation (hereinafter, referred to as "variation in electric resistance") was calculated. Herein, each of measurement of the current with respect to the charging roller before the endurance evaluation, and measurement of the current with respect to the charging roller after the endurance evaluation were performed after each of the charging rollers was placed under "environment 2" for 24 hours and adopted to the environment. The results are shown in Table 6.

[Measurement of Vibration of Charging Roller]

Figure 7:
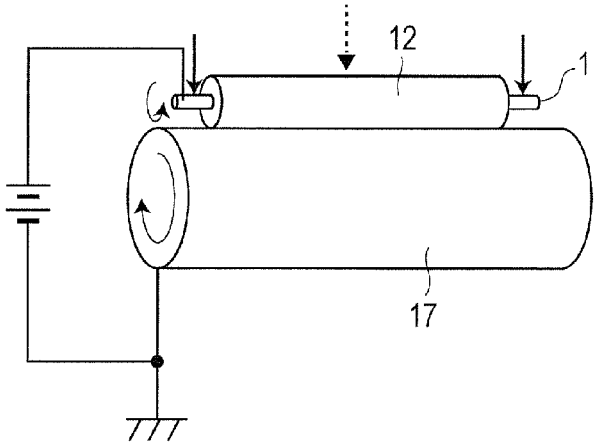
FIG. 7 is an illustrative view of a vibration measurement apparatus for a charging roller.

As illustrated in FIG. 7, the charging roller produced was allowed to abut with an electrophotographic photosensitive member 17 by a spring at a pressing force of 4.9 N at one end thereof and a total pressing force of 9.8 N at both ends thereof, and the electrophotographic photosensitive member 17 was rotated at a rate of 45 mm/sec. As the electrophotographic photosensitive member, a member for use in a process cartridge of a monochrome laser printer (trade name: LaserJet P4515n, manufactured by Hewlett-Packard Development Company, L. P.) was used. With respect to the charging roller, a voltage was applied thereto from the outside under conditions of a peak voltage (Vpp) of 1800 V and a frequency (f) of 2930 Hz with respect to the AC voltage, and a DC voltage (Vdc) of −600 V.

The magnitude of vibration (amplitude) of the charging roller that was rotated following the rotation of the electrophotographic photosensitive member 17 was measured by a laser Doppler vibrometer (trade name: LV-1710, manufactured by Ono Sokki Co., Ltd.). The measurement position was a position that was the center of the charging member in the longitudinal direction and that was opposite to the abutment position with the electrophotographic photosensitive member. The magnitude of vibration was measured and then subjected to frequency analysis, and the amplitude at 5860 Hz was found to be the highest value. Then, the magnitude of vibration (amplitude) at 5860 Hz was shown in Table 6.

Examples 2 to 41

The type of the unvulcanized rubber composition, the type of the surface layer forming coating solution, and the drying temperature and the drying time in the second step were changed as shown in Table 5. The same manner as in Example 1 was conducted except for the above conditions, to produce each of charging roller C-2 to charging roller C-41. The evaluation results are shown in Table 5, Table 6 and Table 7.

Comparative Example 1

An acrylic resin particle (trade name: MBX-30, produced by Sekisui Plastics Co., Ltd.) having a volume average particle size of 30.0 μm and having no pores was used as the resin particle to prepare surface layer forming coating solution T-42. The same manner as in Example 1 was conducted to produce charging roller C-42, except that unvulcanized rubber composition R-2 was used for the elastomer layer, and the drying temperature and the drying time in the second step were changed as shown in Table 5. The evaluation results are shown in Table 5, Table 6 and Table 7.

Comparative Example 2

A resin particle prepared as follows was used as the resin particle, to prepare surface layer forming coating solution T-43.

Calcium tertiary phosphate (10.5 parts by mass) and 0.015 parts by mass of sodium dodecylbenzenesulfonate were added to 300 parts by mass of deionized water to prepare an aqueous medium. Then, an oily mixed solution was prepared in which 65 parts by mass of lauryl methacrylate, 30 parts by mass of ethylene glycol dimethacrylate, 5 parts by mass of poly(ethylene glycol-tetramethylene glycol)monomethacrylate and 0.5 parts by mass of azobisisobutyronitrile were mixed. The oily mixed solution was dispersed in the aqueous medium by a homomixer at a number of rotations of 5000 rpm.

Thereafter, a polymerization reaction container purged with nitrogen was charged therewith, and suspension polymerization was conducted at 70° C. over 8 hours with stirring at 2500 rpm. After cooling, hydrochloric acid was added to the resulting suspension to decompose calcium phosphate, and further filtering and washing with water were repeated. The resultant was dried at 80° C. for 5 hours, and thereafter subjected to a crushing and classification treatment by a sonic classifier to provide a resin particle having an average particle size of 25.4 μm. The cross-section of the particle was observed, and the resin particle was found to be a multi-hollow particle having a plurality of pores of about 3000 nm not opened toward the surface and having no pores opened toward the surface therein.

The same manner as in Example 1 was conducted to produce charging roller C-43, except that unvulcanized rubber composition R-2 was used for the elastomer layer, and the drying temperature and the drying time in the second step were changed as shown in Table 5. The evaluation results are shown in Table 5, Table 6 and Table 7.

TABLE 5

| Example No. | Unvulcanized rubber composition No. | Surface layer forming coating solution No. | Drying temperature (° C.) | Drying time (h) | Volume average particle size (μm) | Mean pore size (nm) | Mean porosity Vt(%) | Porosity measured closer to member surface V1(%) | Porosity measured closer to substrate V2(%) | Solid rate ratio |
|---|---|---|---|---|---|---|---|---|---|---|
| Example 1 | R-1 | T-1 | 60 | 1.0 | 23.8 | 32 | 28.3 | 0.1 | 58.2 | 2.4 |
| Example 2 | R-1 | T-2 | 55 | 1.0 | 25.2 | 33 | 29.9 | 4.6 | 58.1 | 2.3 |
| Example 3 | R-1 | T-3 | 60 | 1.0 | 24.4 | 35 | 32.2 | 0.0 | 64.2 | 2.8 |

TABLE 5-continued

| Example No. | Unvulcanized rubber composition No. | Surface layer forming coating solution No. | Drying temperature (° C.) | Drying time (h) | Volume average particle size (μm) | Mean pore size (nm) | Mean porosity Vt(%) | Porosity measured closer to member surface V1(%) | Porosity measured closer to substrate V2(%) | Solid rate ratio |
|---|---|---|---|---|---|---|---|---|---|---|
| Example 4 | R-1 | T-4 | 55 | 1.0 | 26.3 | 34 | 34.6 | 5.1 | 64.3 | 2.7 |
| Example 5 | R-1 | T-5 | 60 | 0.5 | 24.8 | 31 | 36.8 | 9.6 | 64.1 | 2.5 |
| Example 6 | R-1 | T-6 | 55 | 0.3 | 25.1 | 32 | 41.5 | 19.3 | 63.9 | 2.2 |
| Example 7 | R-1 | T-7 | 80 | 1.0 | 25.2 | 28 | 21.2 | 0.0 | 42.1 | 1.7 |
| Example 8 | R-1 | T-8 | 75 | 1.0 | 26.1 | 29 | 23.3 | 4.8 | 41.8 | 1.6 |
| Example 9 | R-1 | T-9 | 80 | 0.5 | 24.7 | 32 | 26.1 | 9.8 | 42.2 | 1.6 |
| Example 10 | R-1 | T-10 | 55 | 0.3 | 26.7 | 34 | 30.8 | 14.7 | 46.6 | 1.6 |
| Example 11 | R-1 | T-11 | 80 | 1.0 | 25.5 | 28 | 24.4 | 0.1 | 48.3 | 1.9 |
| Example 12 | R-1 | T-12 | 80 | 1.0 | 25.5 | 27 | 15.8 | 0.1 | 31.4 | 1.5 |
| Example 13 | R-1 | T-13 | 75 | 1.0 | 24.9 | 28 | 17.3 | 3.2 | 31.2 | 1.4 |
| Example 14 | R-1 | T-14 | 80 | 0.5 | 25.6 | 30 | 19.2 | 5.8 | 32.1 | 1.4 |
| Example 15 | R-2 | T-15 | 75 | 0.5 | 23.9 | 33 | 21.8 | 11.8 | 31.5 | 1.3 |
| Example 16 | R-1 | T-16 | 80 | 1.0 | 24.3 | 22 | 8.1 | 0.0 | 16.1 | 1.2 |
| Example 17 | R-1 | T-17 | 78 | 1.0 | 26.1 | 25 | 8.3 | 0.4 | 15.8 | 1.2 |
| Example 18 | R-1 | T-18 | 75 | 1.0 | 25.4 | 26 | 9.2 | 2.3 | 15.9 | 1.2 |
| Example 19 | R-1 | T-19 | 75 | 0.5 | 25.3 | 28 | 10.4 | 4.7 | 16.0 | 1.1 |
| Example 20 | R-1 | T-20 | 70 | 0.3 | 26.1 | 32 | 13.1 | 8.2 | 16.2 | 1.1 |
| Example 21 | R-1 | T-21 | 75 | 1.0 | 24.8 | 26 | 10.2 | 0.1 | 20.1 | 1.3 |
| Example 22 | R-1 | T-22 | 75 | 1.0 | 26.3 | 22 | 9.9 | 0.0 | 19.8 | 1.2 |
| Example 23 | R-1 | T-23 | 75 | 1.0 | 25.5 | 35 | 10.2 | 0.2 | 20.3 | 1.3 |
| Example 24 | R-1 | T-24 | 75 | 1.0 | 26.7 | 38 | 9.3 | 0.1 | 18.5 | 1.2 |
| Example 25 | R-1 | T-25 | 70 | 1.0 | 23.9 | 28 | 11.5 | 3.8 | 19.8 | 1.2 |
| Example 26 | R-1 | T-26 | 70 | 1.0 | 25.1 | 30 | 8.3 | 2.6 | 13.9 | 1.1 |
| Example 27 | R-1 | T-27 | 70 | 0.5 | 26.5 | 31 | 13.8 | 7.5 | 19.8 | 1.2 |
| Example 28 | R-1 | T-28 | 70 | 0.5 | 15.3 | 30 | 13.7 | 7.3 | 20.1 | 1.2 |
| Example 29 | R-1 | T-29 | 70 | 0.5 | 20.8 | 31 | 13.9 | 7.4 | 20.3 | 1.2 |
| Example 30 | R-1 | T-30 | 70 | 0.5 | 31.2 | 32 | 13.9 | 7.5 | 20.1 | 1.2 |
| Example 31 | R-2 | T-31 | 70 | 0.5 | 43.2 | 33 | 14.0 | 7.5 | 20.4 | 1.2 |
| Example 32 | R-1 | T-32 | 75 | 1.0 | 26.1 | 26 | 5.6 | 0.1 | 11.0 | 1.1 |
| Example 33 | R-1 | T-33 | 75 | 1.0 | 25.1 | 28 | 5.4 | 0.0 | 10.8 | 1.1 |
| Example 34 | R-1 | T-34 | 75 | 1.0 | 25.3 | 29 | 5.3 | 0.0 | 10.5 | 1.1 |
| Example 35 | R-1 | T-35 | 70 | 0.5 | 24.7 | 30 | 7.8 | 4.8 | 10.3 | 1.1 |
| Example 36 | R-1 | T-36 | 80 | 1.0 | 25.7 | 26 | 2.7 | 0.1 | 5.2 | 1.1 |
| Example 37 | R-1 | T-37 | 75 | 1.0 | 26.7 | 35 | 3.2 | 1.0 | 5.0 | 1.0 |
| Example 38 | R-1 | T-38 | 80 | 1.0 | 24.6 | 42 | 1.7 | 0.2 | 3.2 | 1.0 |
| Example 39 | R-1 | T-39 | 80 | 1.0 | 26.6 | 45 | 2.4 | 0.1 | 4.5 | 1.0 |
| Example 40 | R-1 | T-40 | 75 | 1.0 | 25.7 | 53 | 1.8 | 0.4 | 3.1 | 1.0 |
| Example 41 | R-1 | T-41 | 75 | 1.0 | 24.7 | 55 | 2.0 | 0.5 | 3.4 | 1.0 |
| Comparative Example 1 | R-2 | T-42 | 80 | 1.0 | 29.3 | 0 | 0.0 | 0.0 | 0.0 | 1.0 |
| Comparative Example 2 | R-2 | T-43 | 80 | 1.0 | 23.4 | 2950 | 27.0 | 28.0 | 27.0 | 1.0 |

TABLE 6

| Example No. | Surface roughness Rzjis | Magnitude of vibration of charging roller/nm | Electric resistance before endurance/ $\times 10^5\ \Omega$ | Electric resistance after endurance/ $\times 10^5\ \Omega$ | Variation in electric resistance |
|---|---|---|---|---|---|
| Example 1 | 23.8 | 6 | 4.8 | 5.4 | 1.1 |
| Example 2 | 24.2 | 6 | 4.7 | 5.2 | 1.1 |
| Example 3 | 23.9 | 4 | 5.1 | 5.5 | 1.1 |
| Example 4 | 24.5 | 5 | 5.5 | 5.9 | 1.1 |
| Example 5 | 24.3 | 5 | 4.7 | 5.0 | 1.1 |
| Example 6 | 23.3 | 7 | 4.9 | 5.9 | 1.2 |
| Example 7 | 24.4 | 10 | 5.6 | 7.3 | 1.3 |
| Example 8 | 24.1 | 11 | 5.3 | 6.4 | 1.2 |
| Example 9 | 23.8 | 9 | 5.1 | 6.6 | 1.3 |
| Example 10 | 24.7 | 10 | 4.3 | 5.6 | 1.3 |
| Example 11 | 24.7 | 8 | 4.1 | 4.9 | 1.2 |
| Example 12 | 25.4 | 8 | 5.2 | 7.3 | 1.4 |
| Example 13 | 23.6 | 12 | 3.9 | 5.5 | 1.4 |
| Example 14 | 24.7 | 13 | 4.5 | 6.2 | 1.4 |
| Example 15 | 24.3 | 13 | 6.8 | 9.6 | 1.4 |
| Example 16 | 25.1 | 16 | 5.1 | 7.9 | 1.6 |
| Example 17 | 25.3 | 16 | 5.3 | 8.4 | 1.6 |
| Example 18 | 23.9 | 17 | 4.9 | 7.6 | 1.6 |

TABLE 6-continued

| Example No. | Surface roughness Rzjis | Magnitude of vibration of charging roller/nm | Electric resistance before endurance/ $\times 10^5\ \Omega$ | Electric resistance after endurance/ $\times 10^5\ \Omega$ | Variation in electric resistance |
|---|---|---|---|---|---|
| Example 19 | 24.2 | 17 | 4.8 | 7.6 | 1.6 |
| Example 20 | 24.8 | 17 | 4.7 | 7.4 | 1.6 |
| Example 21 | 23.8 | 12 | 4.7 | 6.5 | 1.4 |
| Example 22 | 24.4 | 13 | 5.8 | 7.9 | 1.4 |
| Example 23 | 25.5 | 12 | 3.7 | 5.2 | 1.4 |
| Example 24 | 25.3 | 13 | 6.1 | 8.7 | 1.4 |
| Example 25 | 24.9 | 14 | 5.6 | 8.3 | 1.5 |
| Example 26 | 25.1 | 15 | 4.3 | 6.5 | 1.5 |
| Example 27 | 25.1 | 15 | 4.8 | 7.2 | 1.5 |
| Example 28 | 15.4 | 14 | 3.4 | 5.1 | 1.5 |
| Example 29 | 19.8 | 14 | 4.5 | 6.7 | 1.5 |
| Example 30 | 32.1 | 15 | 5.7 | 8.4 | 1.5 |
| Example 31 | 39.4 | 14 | 7.1 | 10.5 | 1.5 |
| Example 32 | 26.4 | 18 | 5.8 | 10.7 | 1.9 |
| Example 33 | 26.3 | 19 | 4.6 | 8.6 | 1.9 |
| Example 34 | 24.4 | 18 | 5.4 | 10.0 | 1.9 |
| Example 35 | 25.5 | 21 | 5.5 | 13.8 | 2.5 |
| Example 36 | 23.3 | 20 | 5.3 | 10.6 | 2.0 |

TABLE 6-continued

| Example No. | Surface roughness Rzjis | Magnitude of vibration of charging roller/nm | Electric resistance before endurance/ $\times 10^5\ \Omega$ | Electric resistance after endurance/ $\times 10^5\ \Omega$ | Variation in electric resistance |
|---|---|---|---|---|---|
| Example 37 | 23.4 | 22 | 4.9 | 12.7 | 2.6 |
| Example 38 | 23.5 | 22 | 4.6 | 11.0 | 2.4 |
| Example 39 | 26.4 | 21 | 5.2 | 13.5 | 2.6 |
| Example 40 | 23.3 | 21 | 5.2 | 14.0 | 2.7 |
| Example 41 | 24.4 | 22 | 5.3 | 16.4 | 3.1 |
| Comparative Example 1 | 25.8 | 35 | 7.5 | 97.5 | 13.0 |
| Comparative Example 2 | 18.3 | 30 | 6.8 | 66.6 | 9.8 |

TABLE 7

| Example | Environment of temperature 15° C./humidity 10% RH | | | | Environment of temperature 23° C./humidity 50% RH | | | | Environment of temperature 30° C./humidity 80% RH | | | |
|---|---|---|---|---|---|---|---|---|---|---|---|---|
| | Initial | 10K sheets | 20K sheets | 30K sheets | Initial | 10K sheets | 20K sheets | 30K sheets | Initial | 10K sheets | 20K sheets | 30K sheets |
| Example 1 | 1 | 1 | 1 | 2 | 1 | 1 | 1 | 1 | 1 | 1 | 1 | 1 |
| Example 2 | 1 | 1 | 1 | 2 | 1 | 1 | 1 | 1 | 1 | 1 | 1 | 1 |
| Example 3 | 1 | 1 | 1 | 1 | 1 | 1 | 1 | 1 | 1 | 1 | 1 | 1 |
| Example 4 | 1 | 1 | 1 | 1 | 1 | 1 | 1 | 1 | 1 | 1 | 1 | 1 |
| Example 5 | 1 | 1 | 1 | 1 | 1 | 1 | 1 | 1 | 1 | 1 | 1 | 1 |
| Example 6 | 1 | 1 | 1 | 2 | 1 | 1 | 1 | 2 | 1 | 1 | 1 | 1 |
| Example 7 | 1 | 1 | 2 | 2 | 1 | 1 | 1 | 2 | 1 | 1 | 1 | 2 |
| Example 8 | 1 | 1 | 2 | 2 | 1 | 1 | 1 | 2 | 1 | 1 | 1 | 2 |
| Example 9 | 1 | 1 | 2 | 2 | 1 | 1 | 1 | 2 | 1 | 1 | 1 | 2 |
| Example 10 | 1 | 1 | 2 | 2 | 1 | 1 | 2 | 2 | 1 | 1 | 1 | 2 |
| Example 11 | 1 | 1 | 1 | 2 | 1 | 1 | 1 | 2 | 1 | 1 | 1 | 2 |
| Example 12 | 1 | 1 | 2 | 2 | 1 | 1 | 2 | 2 | 1 | 1 | 2 | 2 |
| Example 13 | 1 | 1 | 2 | 2 | 1 | 1 | 2 | 2 | 1 | 1 | 2 | 2 |
| Example 14 | 1 | 1 | 2 | 2 | 1 | 1 | 2 | 2 | 1 | 1 | 2 | 2 |
| Example 15 | 1 | 2 | 2 | 2 | 1 | 1 | 2 | 2 | 1 | 1 | 2 | 2 |
| Example 16 | 1 | 2 | 2 | 2 | 1 | 2 | 2 | 2 | 1 | 2 | 2 | 2 |
| Example 17 | 1 | 2 | 2 | 2 | 1 | 2 | 2 | 2 | 1 | 2 | 2 | 2 |
| Example 18 | 1 | 2 | 2 | 2 | 1 | 2 | 2 | 2 | 1 | 2 | 2 | 2 |
| Example 19 | 1 | 2 | 2 | 2 | 1 | 2 | 2 | 2 | 1 | 2 | 2 | 2 |
| Example 20 | 2 | 2 | 2 | 2 | 1 | 2 | 2 | 2 | 1 | 2 | 2 | 2 |
| Example 21 | 1 | 1 | 2 | 2 | 1 | 1 | 2 | 2 | 1 | 1 | 2 | 2 |
| Example 22 | 1 | 1 | 2 | 2 | 1 | 1 | 2 | 2 | 1 | 1 | 2 | 2 |
| Example 23 | 1 | 1 | 2 | 2 | 1 | 1 | 2 | 2 | 1 | 1 | 2 | 2 |
| Example 24 | 1 | 1 | 2 | 2 | 1 | 1 | 2 | 2 | 1 | 1 | 2 | 2 |
| Example 25 | 1 | 2 | 2 | 2 | 1 | 1 | 2 | 2 | 1 | 1 | 2 | 2 |
| Example 26 | 1 | 2 | 2 | 2 | 1 | 1 | 2 | 2 | 1 | 1 | 2 | 2 |
| Example 27 | 1 | 2 | 2 | 2 | 1 | 2 | 2 | 2 | 1 | 1 | 2 | 2 |
| Example 28 | 1 | 2 | 2 | 2 | 1 | 2 | 2 | 2 | 1 | 1 | 2 | 2 |
| Example 29 | 1 | 2 | 2 | 2 | 1 | 2 | 2 | 2 | 1 | 1 | 2 | 2 |
| Example 30 | 1 | 2 | 2 | 2 | 1 | 2 | 2 | 2 | 1 | 1 | 2 | 2 |
| Example 31 | 1 | 2 | 2 | 2 | 1 | 2 | 2 | 2 | 1 | 1 | 2 | 2 |
| Example 32 | 2 | 2 | 2 | 2 | 2 | 2 | 2 | 2 | 2 | 2 | 2 | 2 |
| Example 33 | 2 | 2 | 2 | 2 | 2 | 2 | 2 | 2 | 2 | 2 | 2 | 2 |
| Example 34 | 2 | 2 | 2 | 2 | 2 | 2 | 2 | 2 | 2 | 2 | 2 | 2 |
| Example 35 | 2 | 2 | 3 | 3 | 2 | 2 | 3 | 3 | 2 | 2 | 3 | 3 |
| Example 36 | 2 | 2 | 2 | 3 | 2 | 2 | 2 | 3 | 2 | 2 | 2 | 3 |
| Example 37 | 2 | 2 | 3 | 3 | 2 | 2 | 3 | 3 | 2 | 2 | 3 | 3 |
| Example 38 | 2 | 2 | 3 | 3 | 2 | 2 | 3 | 3 | 2 | 2 | 3 | 3 |
| Example 39 | 2 | 2 | 3 | 3 | 2 | 2 | 3 | 3 | 2 | 2 | 3 | 3 |
| Example 40 | 2 | 3 | 3 | 3 | 2 | 3 | 3 | 3 | 2 | 3 | 3 | 3 |
| Example 41 | 2 | 3 | 3 | 3 | 2 | 3 | 3 | 3 | 2 | 3 | 3 | 3 |
| Comparative Example 1 | 3 | 4 | 4 | 4 | 3 | 4 | 4 | 4 | 3 | 4 | 4 | 4 |
| Comparative Example 2 | 3 | 4 | 4 | 4 | 3 | 3 | 4 | 4 | 3 | 3 | 4 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-086421, filed Apr. 18, 2014, which is hereby incorporated by reference herein in its entirety.

What is claimed is:

1. A charging member comprising:

an electro-conductive substrate; and a surface layer, wherein:

the surface layer comprises a binder resin, and a resin particle that roughens the surface layer;

a surface of the charging member has a plurality of protrusions each derived from the resin particle;

the resin particle has a pore inside thereof, has a porosity Vt of 1.5% by volume or more and 45.0% by volume or less as a whole, and has a first region and a second region, wherein:

assuming that the resin particle is a solid particle having no pores, each of the first region and the second region corresponds to a region occupying ½ of a total volume of the solid particle, the first region being located in the resin particle nearest to the electro-conductive substrate, and having a porosity V1 of 2.0% by volume or more and 90.0% by volume or less, the second region being located in the resin particle farthest away from the electro-conductive substrate, and having a porosity V2 of 0.0% by volume or more and 20.0% by volume or less, and wherein:

the porosity V1 is larger than the porosity V2.

2. The charging member according to claim 1, wherein assuming that the first region is a first solid region having no pores, a ratio of a volume of a portion other than a pore in the first region to a volume of the first solid region is defined as a first solid rate, and assuming that the second region is a second solid region having no pores, a ratio of a volume of a portion other than a pore in the second region to a volume of the solid region is defined as a second solid rate, a value of (second solid rate/first solid rate) is 1.1 or more.

3. The charging member according to claim 1, wherein the porosity V1 is 56% by volume or more and 90% by volume or less, and the porosity V2 is 0% by volume or more and 5% by volume or less.

4. The charging member according to claim 1, wherein a volume average particle size of the resin particle is 5 μm or more and 50 μm or less.

5. The charging member according to claim 1, wherein a mean pore size of the resin particle is 10 nm or more and 100 nm or less.

6. The charging member according to claim 1, wherein the resin particle comprises at least one resin selected from an acrylic resin, a styrene resin and a styrene acrylic resin.

7. The charging member according to claim 1, wherein a 10-point average roughness Rzjis of a surface of the charging member is 5 μm or more and 65 μm or less.

8. A process cartridge detachably mountable on a main body of an electrophotographic apparatus, comprising:

a charging member; and a member to be charged disposed in contact with the charging member, wherein the charging member is the charging member according to claim 1.

9. An electrophotographic image forming apparatus comprising:

a charging member; and a member to be charged disposed in contact with the charging member, wherein the charging member is the charging member according to claim 1.

* * * * *